US009039545B2

(12) United States Patent
Watanabe et al.

(10) Patent No.: US 9,039,545 B2
(45) Date of Patent: May 26, 2015

(54) MULTI-PIECE SOLID GOLF BALL

(75) Inventors: Hideo Watanabe, Chichibushi (JP); Junji Umezawa, Chichibushi (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 592 days.

(21) Appl. No.: 12/910,395

(22) Filed: Oct. 22, 2010

(65) Prior Publication Data

US 2012/0100932 A1 Apr. 26, 2012

(51) Int. Cl.
*A63B 37/06* (2006.01)
*A63B 37/00* (2006.01)

(52) U.S. Cl.
CPC ..... *A63B 37/0031* (2013.01); *A63B 37/0033* (2013.01); *A63B 37/0043* (2013.01); *A63B 37/0045* (2013.01); *A63B 37/0062* (2013.01); *A63B 37/0065* (2013.01); *A63B 37/0076* (2013.01); *A63B 37/0092* (2013.01)

(58) Field of Classification Search
USPC ..... 473/376
See application file for complete search history.

(56) References Cited

U.S. PATENT DOCUMENTS

| | | | | |
|---|---|---|---|---|
| 5,306,760 | A | 4/1994 | Sullivan | |
| 5,312,857 | A | 5/1994 | Sullivan | |
| 6,194,505 | B1 | 2/2001 | Sone et al. | |
| 6,302,808 | B1 | 10/2001 | Dalton et al. | |
| 6,416,425 | B1 | 7/2002 | Maruko et al. | |
| 6,419,595 | B1 | 7/2002 | Maruko et al. | |
| 6,642,314 | B2 | 11/2003 | Sone et al. | |
| 7,294,680 | B2 | 11/2007 | Sone et al. | |
| 7,445,567 | B2 * | 11/2008 | Watanabe | 473/376 |
| 2003/0180389 | A1 | 9/2003 | Phillips | |
| 2009/0111611 | A1 * | 4/2009 | Kimura et al. | 473/373 |
| 2009/0170634 | A1 | 7/2009 | Loper et al. | |

FOREIGN PATENT DOCUMENTS

| | | | |
|---|---|---|---|
| JP | 11-35633 | A | 2/1999 |
| JP | 11-164912 | A | 6/1999 |
| JP | 2001-17569 | A | 1/2001 |
| JP | 2001-17570 | A | 1/2001 |
| JP | 2001-37914 | A | 2/2001 |
| JP | 2002-293996 | A | 10/2002 |
| JP | 2008-149131 | A | 7/2008 |
| JP | 2009-95365 | A | 5/2009 |
| JP | 2009-95369 | A | 5/2009 |
| JP | 2009-160407 | A | 7/2009 |
| WO | 98/46671 | A1 | 10/1998 |

* cited by examiner

*Primary Examiner* — Raeann Gorden
(74) *Attorney, Agent, or Firm* — Sughrue Mion, PLLC

(57) ABSTRACT

A multi-piece solid golf ball having a core, an envelope layer having an inner envelope layer, intermediate envelope layer and outer envelope layer, an intermediate layer, and a cover having a plurality of dimples formed on a surface thereof, arranged in that order. The three envelope layers, intermediate layer and cover are each formed primarily of a resin material of the same or different types. The core is formed primarily of a rubber material, and has a material hardness higher than the core center hardness. One of the inner layers has a material hardness higher than either or both of the cover material hardness and the average core hardness. The golf ball lowers the spin rate on full shots with a driver, increases the distance traveled by the ball, has good controllability, maintains a straight path particularly on full shots, has a good feel on impact and excellent scuff resistance.

15 Claims, 2 Drawing Sheets

MULTI-PIECE SOLID GOLF BALL

BACKGROUND OF THE INVENTION

The present invention relates to a multi-piece solid golf ball composed of a core, an envelope layer, an intermediate layer and a cover that have been formed as successive layers. More specifically, the invention relates to a multi-piece solid golf ball which has a satisfactory flight performance and controllability even when used by professionals and other skilled golfers, and also has a good feel on impact and an excellent scuff resistance.

Key performance features required in a golf ball include distance, controllability, durability and feel. Balls having these qualities in the highest degree are constantly being sought. Among recent golf balls, a succession of balls having multi-piece structures which are typically composed of three pieces have emerged. By having the structure of a golf ball be multilayered, it is possible to combine many materials of different properties, thus enabling a wide variety of ball designs in which each layer has a particular function.

In particular, multi-piece solid golf balls having an optimized hardness relationship among the respective layers encasing the core, such as the intermediate layer and cover, have come into widespread use. Recently, in addition to the flight performance of a ball, the durability of the ball to repeated impact (which inhibits crack formation) and the scuff resistance (which inhibits burr formation on the ball surface) have also become important factors in evaluating ball performance. Therefore, a major challenge is to design the thickness and hardness of the respective ball layers in such a way as to maximize these effects.

With regard to golf balls for professionals and other skilled golfers in particular, there exists a desire for the development of balls in which the thickness and hardness of each layer encasing the core, such as the intermediate layer and the cover layer, have been highly optimized in order to provide the ball with a good feel and excellent durability and to achieve a superior distance performance in the high head speed range as well as precise controllability on shots with an iron and on approach shots.

Golf balls having such a multilayer structure have been disclosed in, for example, JP-A 2009-160407, U.S. Pat. No. 6,302,808, JP-A 2001-017569, JP-A 2001-017570, JP-A 2001-037914, JP-A 2008-149131, JP-A 2009-095365 and JP-A 2009-095369. However, because these lack a sufficient spin rate-lowering effect on full shots, there remains room for improvement in increasing the distance.

SUMMARY OF THE INVENTION

It is therefore an object of the present invention to provide a multi-piece solid golf ball which has a flight performance and controllability that are acceptable to professionals and other skilled golfers, is able to achieve an increased distance even on full shots with an iron, and also has an excellent scuff resistance.

The inventors have conducted extensive investigations in order to attain the above object. As a result, they have discovered that, by adopting a basic ball construction wherein the layers encasing the core have a multilayer structure of five or more layers which includes, in order from the inner side: an inner envelope layer, an intermediate envelope layer, an outer envelope layer, an intermediate layer and a cover, and by optimizing the hardness relationship among these various layers in such a way that the material hardness of the cover is higher than the center hardness of the core, and the material hardness of one of the inner layers (the envelope layers and the intermediate layer) is higher than the material hardness of the cover and/or the average core hardness (defined as the arithmetic mean of the core center hardness and the core surface hardness), there can be obtained a golf ball which, on shots with a driver, has a flight performance and controllability that are fully satisfactory even to professionals and other skilled golfers, which has an excellent flight performance and controllability on full shots with an iron, and which moreover has an excellent scuff resistance.

Accordingly, the invention provides the following multi-piece solid golf ball.

[1] A multi-piece solid golf ball comprising a core, an envelope layer encasing the core, an intermediate layer encasing the envelope layer, and a cover which encases the intermediate layer and has formed on a surface thereof a plurality of dimples, wherein the envelope layer is comprised of an inner envelope layer, an intermediate envelope layer and an outer envelope layer; the inner, intermediate and outer envelope layers, the intermediate layer and the cover are each formed primarily of a resin material which may be of the same or different types; the core is formed primarily of a rubber material; the cover has a material hardness (Shore D) which is higher than a core center hardness (Shore D); and one of the inner layers has a material hardness (Shore D) which is higher than either or both of the cover material hardness (Shore D) and the average core hardness (defined as the arithmetic mean of the core surface hardness and the core center hardness).

[2] The multi-piece solid golf ball of [1], wherein the intermediate envelope layer is formed so as to be harder than the inner envelope layer and to have a material hardness difference (Shore D) with the inner envelope layer of from 1 to 6, and so as to be softer than the outer envelope layer and to have a material hardness difference (Shore D) with the outer envelope layer of from 1 to 6.

[3] The multi-piece solid golf ball of [1], wherein the intermediate layer and the cover have thicknesses which satisfy the following relationship:

$$1.3 \leq \text{intermediate layer thickness/cover thickness} \leq 4.0.$$

[4] The multi-piece solid golf ball of [1], wherein the inner envelope layer, intermediate envelope layer and outer envelope layer have thicknesses which satisfy the following relationship:

$$\text{inner envelope layer thickness} \geq \text{intermediate envelope layer thickness} \geq \text{outer envelope layer thickness}.$$

[5] The multi-piece solid golf ball of [1], wherein the intermediate layer is formed of a material which includes an ionomer resin having an acid content of at least 16 wt %.

[6] The multi-piece solid golf ball of [1], wherein the core center, outer envelope layer, intermediate layer and cover have hardnesses (Shore D) which satisfy the following relationship:

$$\text{cover material hardness} < \text{intermediate layer material hardness} > \text{outer envelope layer material hardness} > \text{core center hardness}.$$

[7] The multi-piece solid golf ball of [1], wherein the core center, inner envelope layer, intermediate envelope layer, outer envelope layer, intermediate layer and cover have hardnesses (Shore D) which satisfy the following relationship:

$$\text{cover material hardness} < \text{intermediate layer material hardness} > \text{outer envelope layer material hardness} > \text{intermediate envelope layer material hardness} > \text{inner envelope layer material hardness} > \text{core center hardness}.$$

[8] The multi-piece solid golf ball of [1], wherein the core, inner envelope layer, intermediate envelope layer, outer envelope layer, intermediate layer and cover have thicknesses which satisfy the following relationship:

cover thickness<intermediate layer thickness<(outer envelope layer thickness+intermediate envelope layer thickness+inner envelope layer thickness) <core diameter.

[9] The multi-piece solid golf ball of [1], wherein the inner envelope layer, intermediate envelope layer, outer envelope layer, intermediate layer and cover have thicknesses which satisfy the following relationship:

(cover thickness+intermediate layer thickness)<(outer envelope layer thickness+intermediate envelope layer thickness+inner envelope layer thickness).

[10] The multi-piece solid golf ball of [1], wherein at least one layer from among the inner envelope layer, intermediate envelope layer and outer envelope layer is formed of a material obtained by blending:

an ionomer resin component of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (e) a non-ionomeric thermoplastic elastomer in a weight ratio between 100:0 and 50:50.

[11] The multi-piece solid golf ball of [1], wherein at least one layer from among the inner envelope layer, intermediate envelope layer and outer envelope layer is formed of a material obtained by blending as essential components:

100 parts by weight of a resin component composed of, in admixture, a base resin of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (e) a non-ionomeric thermoplastic elastomer in a weight ratio between 100:0 and 50:50;

(c) from 5 to 120 parts by weight of a fatty acid and/or fatty acid derivative having a molecular weight of from 228 to 1500; and (d) from 0.1 to 17 parts by weight of a basic inorganic metal compound capable of neutralizing un-neutralized acid groups in the base resin and component (c).

[12] The multi-piece solid golf ball of [11], wherein at least two layers from among the inner envelope layer, intermediate envelope layer and outer envelope layer are formed of the material of [11].

[13] The multi-piece solid golf ball of [11], wherein the inner envelope layer, intermediate envelope layer and outer envelope layer are all formed of the material of [11].

[14] The multi-piece solid golf ball, wherein the core has a deflection when compressed under a final load of 1,275 N (130 kgf) from an initial load state of 98 N (10 kgf) of at least 3.6 mm but not more than 12.0 mm.

[15] The multi-piece solid golf ball of [1], wherein the envelope layer has a thickness which is at least twice the thickness of the intermediate layer.

[16] The multi-piece solid golf ball of [1], wherein the cover is formed by injection molding a single resin blend composed primarily of (A) a thermoplastic polyurethane and (B) a polyisocyanate compound, which resin blend contains a polyisocyanate compound in at least some portion of which all the isocyanate groups remain in an unreacted state.

BRIEF DESCRIPTION OF THE DIAGRAMS

DETAILED DESCRIPTION OF THE INVENTION

Figure 1:
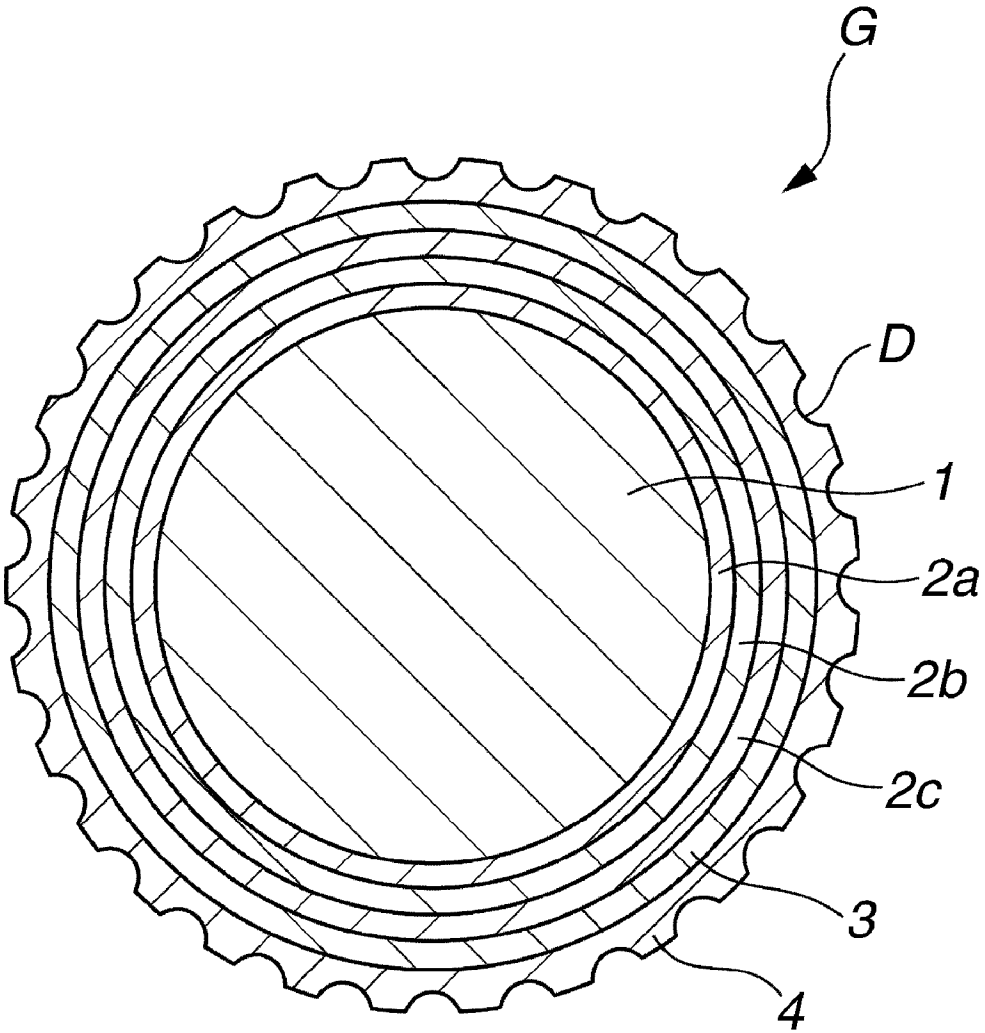
FIG. 1 is a schematic sectional view showing a multi-piece solid golf ball (six-layer construction) according to the invention.

The invention is described more fully below. The multi-piece solid golf ball of the present invention, as shown in FIG. 1, is a golf ball G with a six-layer construction that includes a core 1, an inner envelope layer 2*a*, intermediate envelope layer 2*b* and outer envelope layer 2*c* which encase the core, an intermediate layer 3 which encases the envelope layers, and a cover 4 which encases the intermediate layer 3. The cover 4 typically has a large number of dimples D formed on the surface thereof. The core 1, the intermediate layer 3 and the cover 4 are not limited to single layers, and may each be formed of a plurality of two more layers.

In the invention, the core has a diameter which, although not subject to any particular limitation, is preferably at least 20 mm, more preferably at least 22 mm, and even more preferably at least 24 mm. The upper limit of the diameter, although not subject to any particular limitation, is preferably not more than 35 mm, more preferably not more than 30 mm, and even more preferably not more than 28 mm. At a core diameter outside this range, the ball may have a lower initial velocity and the spin rate-lowering effect after the ball is hit may be inadequate, as a result of which an increased distance may not be achieved.

The core has a surface hardness which, although not subject to any particular limitation, has a JIS-C hardness value of preferably at least 40, more preferably at least 45, and even more preferably at least 50. The upper limit, although not subject to any particular limitation, is preferably not more than 95, more preferably not more than 90, and even more preferably not more than 85. The above hardness range, when expressed as the Shore D hardness, is preferably at least 22, more preferably at least 26, and even more preferably at least 30. The upper limit is preferably not more than 64, more preferably not more than 60, and even more preferably not more than 57.

It is critical for the core to have a center hardness which is lower than the subsequently described cover hardness. The core center hardness may be set to a JIS-C hardness of preferably at least 30, more preferably at least 35, and even more preferably at least 42. The upper limit is preferably not more than 72, more preferably not more than 68, and even more preferably not more than 63. The above hardness range, when expressed as the Shore D hardness, is preferably at least 15, more preferably at least 19, and even more preferably at least 24. The upper limit is preferably not more than 47, more preferably not more than 44, and even more preferably not more than 40.

The arithmetic mean of the core surface hardness and the core center hardness (referred to below as the "average core hardness"), although not subject to any particular limitation, may be set to a JIS-C hardness of preferably at least 35, more preferably at least 40, and even more preferably at least 46. The upper limit is preferably not more than 84, more preferably not more than 79, and even more preferably not more than 74. The above hardness range, when expressed as the Shore D hardness, is preferably at least 19, more preferably at least 22, and even more preferably at least 27. The upper limit is preferably not more than 56, more preferably not more than 52, and even more preferably not more than 48.

At a core surface hardness and center hardness below the above ranges, the core may have an inadequate resilience, as a result of which an increased distance may not be achieved, the feel of the ball on impact may be too soft and the durability of the ball to cracking on repeated impact may worsen. Conversely, at core hardness values higher than the above ranges, the ball may have an excessively hard feel on full shots and the spin rate may be too high, as a result of which an increased distance may not be achieved.

Although not subject to any particular limitation, the core surface hardness (Shore D) is preferably about the same as or lower than the material hardnesses (Shore D) of the envelope layers. When the core surface hardness (Shore D) is higher than the material hardnesses of the envelope layers, the spin rate-lowering effect may be inadequate, as a result of which a sufficient distance may not be achieved on shots with a driver or an iron.

In the present invention, the core must increase in hardness from the center to the surface thereof. Here, the hardness difference between the center and the surface of the core, expressed as the JIS-C hardness, is preferably at least 5, more preferably at least 7, and even more preferably at least 9. The upper limit is preferably not more than 30, more preferably not more than 25, and even more preferably not more than 20. If this difference is too small, the spin rate may become too high, as a result of which an increased distance may not be achieved. On the other hand, if the difference is too large, the durability to repeated impact may worsen or the rebound may decrease, as a result of which an increased distance may not be achieved.

The core has a deflection when subjected to compressive loading, i.e., when compressed under a final load of 1,275 N (130 kgf) from an initial load state of 98 N (10 kgf), which, while not subject to any particular limitation, is preferably at least 3.6 mm, more preferably at least 4.0 mm, and even more preferably at least 4.5 mm. The upper limit, although not subject to any particular limitation, is preferably not more than 12.0 mm, more preferably not more than 10.0 mm, and even more preferably not more than 9.0 mm. If this value is too high, the resilience of the core may become too low, resulting in an insufficient distance, the feel may become too soft, or the durability of the ball to cracking on repeated impact may worsen. On the other hand, if this value is too low, the ball may have an excessively hard feel on full shots, or the spin rate may be too high, as a result of which an increased distance may not be achieved.

A material composed primarily of rubber may be used to form the core having the above-described surface hardness and deflection. For example, the core may be formed of a rubber composition containing, in addition to the rubber component, a co-crosslinking agent, an organic peroxide, an inert filler and an organosulfur compound. Polybutadiene is preferably used as the base rubber of this rubber composition.

It is desirable for the polybutadiene to have a cis-1,4 bond content on the polymer chain of at least 60 wt %, preferably at least 80 wt %, more preferably at least 90 wt %, and most preferably at least 95 wt %. Too low a cis-1,4 bond content among the bonds on the molecule may result in a lower resilience.

Also, the polybutadiene has a 1,2-vinyl bond content on the polymer chain of preferably not more than 2%, more preferably not more than 1.7%, and even more preferably not more than 1.5%. Too high a 1,2-vinyl bond content may result in a lower resilience.

To obtain a molded and vulcanized rubber composition of good resilience, the polybutadiene used in the invention is preferably one synthesized with a rare-earth catalyst or a Group VIII metal compound catalyst. Polybutadiene synthesized with a rare-earth catalyst is especially preferred.

Such rare-earth catalysts are not subject to any particular limitation. Exemplary rare-earth catalysts include those made up of a combination of a lanthanide series rare-earth compound with an organoaluminum compound, an alumoxane, a halogen-bearing compound and an optional Lewis base.

Examples of suitable lanthanide series rare-earth compounds include halides, carboxylates, alcoholates, thioalcoholates and amides of atomic number 57 to 71 metals.

In the practice of the invention, the use of a neodymium catalyst in which a neodymium compound serves as the lanthanide series rare-earth compound is particularly advantageous because it enables a polybutadiene rubber having a high cis-1,4 bond content and a low 1,2-vinyl bond content to be obtained at an excellent polymerization activity. Suitable examples of such rare-earth catalysts include those mentioned in JP-A 11-35633, JP-A 11-164912 and JP-A 2002-293996.

To enhance the resilience, it is preferable for the polybutadiene synthesized using the lanthanide series rare-earth compound catalyst to account for at least 10 wt %, preferably at least 20 wt %, and more preferably at least 40 wt %, of the rubber components.

Rubber components other than the above-described polybutadiene may be included in the base rubber insofar as the objects of the invention are attainable. Illustrative examples of rubber components other than the above-described polybutadiene include other polybutadienes, and other diene rubbers, such as styrene-butadiene rubber, natural rubber, isoprene rubber and ethylene-propylene-diene rubber.

Examples of co-crosslinking agents include unsaturated carboxylic acids and the metal salts of unsaturated carboxylic acids.

Specific examples of unsaturated carboxylic acids include acrylic acid, methacrylic acid, maleic acid and fumaric acid. Acrylic acid and methacrylic acid are especially preferred.

The metal salts of unsaturated carboxylic acids, while not subject to any particular limitation, are exemplified by the above-mentioned unsaturated carboxylic acids neutralized with a desired metal ion. Specific examples include the zinc and magnesium salts of methacrylic acid and acrylic acid. The use of zinc acrylate is especially preferred.

The amount of unsaturated carboxylic acid and/or metal salt thereof included per 100 parts by weight of the base rubber may be set to preferably at least 2 parts by weight, more preferably at least 4 parts by weight, and even more preferably at least 6 parts by weight. The upper limit may be set to preferably not more than 60 parts by weight, more preferably not more than 45 parts by weight, even more preferably not more than 35 parts by weight, and most preferably not more than 25 parts by weight. Too much may make the core too hard, giving the ball an unpleasant feel on impact, whereas too little may lower the rebound.

The organic peroxide may be a commercially available product, suitable examples of which include Percumyl D (available from NOF Corporation), Perhexa C-40 and Perhexa 3M (both available from NOF Corporation), and Luperco 231XL (Atochem Co.). These may be used singly or as a combination of two or more thereof.

The amount of organic peroxide included per 100 parts by weight of the base rubber may be set to preferably at least 0.1 part by weight, more preferably at least 0.3 part by weight, even more preferably at least 0.5 part by weight, and most preferably at least 0.7 part by weight. The upper limit may be set to preferably not more than 5 parts by weight, more preferably not more than 4 parts by weight, even more preferably not more than 3 parts by weight, and most preferably not more than 2 parts by weight. Too much or too little organic peroxide may make it impossible to achieve a ball having a good feel, durability and rebound.

Examples of suitable inert fillers include zinc oxide, barium sulfate and calcium carbonate. These may be used singly or as a combination of two or more thereof.

The amount of inert filler included per 100 parts by weight of the base rubber may be set to preferably at least 1 part by weight, and more preferably at least 5 parts by weight. The upper limit may be set to preferably not more than 200 parts by weight, more preferably not more than 150 parts by weight, and even more preferably not more than 110 parts by weight. Too much or too little inert filler may make it impossible to achieve a proper weight and a good rebound.

In addition, an antioxidant may be included if necessary. Illustrative examples of suitable commercial antioxidants include Nocrac NS-6, Nocrac NS-30 (both available from Ouchi Shinko Chemical Industry Co., Ltd.), and Yoshinox 425 (Yoshitomi Pharmaceutical Industries, Ltd.). These may be used singly or as a combination of two or more thereof.

The amount of antioxidant included may be more than 0, and is set to preferably at least 0.05 part by weight, and especially at least 0.1 part by weight, per 100 parts by weight of the base rubber. The upper limit, although not subject to any particular limitation, may be set to preferably not more than 3 parts by weight, more preferably not more than 2 parts by weight, even more preferably not more than 1 part by weight, and most preferably not more than 0.5 part by weight, per 100 parts by weight of the base rubber. Too much or too little antioxidant may make it impossible to achieve a good rebound and durability.

To enhance the rebound of the golf ball and increase its initial velocity, it is preferable to include an organosulfur compound in the above base rubber. No particular limitation is imposed on the organosulfur compound, provided it improves the rebound of the golf ball. Exemplary organosulfur compounds include thiophenols, thionaphthols, halogenated thiophenols, and metal salts thereof. Specific examples include pentachlorothiophenol, pentafluorothiophenol, pentabromothiophenol, p-chlorothiophenol, the zinc salt of pentachlorothiophenol, the zinc salt of pentafluorothiophenol, the zinc salt of pentabromothiophenol, the zinc salt of p-chlorothiophenol; and diphenylpolysulfides, dibenzylpolysulfides, dibenzoylpolysulfides, dibenzothiazoylpolysulfides and dithiobenzoylpolysulfides having 2 to 4 sulfurs. The zinc salt of pentachlorothiophenol is especially preferred.

The amount of such an organosulfur compound included per 100 parts by weight of the base rubber may be set to preferably at least 0.05 part by weight, more preferably at least 0.1 part by weight, and even more preferably at least 0.2 part by weight. It is recommended that the upper limit in the amount of the organosulfur compound included per 100 parts by weight of the base rubber be preferably not more than 5 parts by weight, more preferably not more than 3 parts by weight, and even more preferably not more than 2.5 parts by weight. If too much organosulfur compound is included, further improvement in the rebound (especially when struck with a W#1) is unlikely to be achieved and the core may become too soft, possibly resulting in a poor feel.

Next, the envelope layer is described.

In the present invention, as noted above, the envelope layer encasing the core is formed of three layers: an inner envelope layer, an intermediate envelope layer, and an outer envelope layer.

The inner envelope layer has a material hardness, expressed as the Shore D hardness (measured with a type D durometer in general accordance with ASTM D 2240), which, while not subject to any particular limitation, is preferably at least 38, more preferably at least 40, and even more preferably at least 43. The upper limit, although not subject to any particular limitation, is preferably not more than 60, more preferably not more than 55, and even more preferably not more than 50. It is preferable for the inner envelope layer to be formed so as to be softer than the intermediate envelope layer. If the inner envelope layer is too soft, the ball may have too much spin receptivity on full shots, as a result of which an increased distance may not be achieved. On the other hand, if the inner envelope layer is too hard, the durability of the ball to cracking under repeated impact may worsen or the ball may have too hard a feel when played. As used herein, "material hardness" refers to, in cases where the material is a resin, the measured hardness of a 2 mm thick sheet produced by molding the resin composition under applied pressure. In cases where the material is a rubber, the "material hardness" refers to the measured hardness of a pressed sheet having a thickness of about 2 mm produced by loading the rubber composition into a sheet-forming mold and hot molding at 170° C. for 15 minutes (the same applies below).

The inner envelope layer has a thickness which, although not subject to any particular limitation, is preferably at least 1.0 mm, more preferably at least 1.5 mm, and even more preferably at least 2.0 mm. The upper limit, although not subject to any particular limitation, is preferably not more than 4.0 mm, more preferably not more than 3.5 mm, and even more preferably not more than 3.0 mm. At an inner envelope layer thickness outside this range, the spin rate-lowering effect on shots with a driver (W#1) may be inadequate, as a result of which an increased distance may not be achieved.

The intermediate envelope layer which encases the inner envelope layer has a material hardness, expressed as the Shore D hardness, which, although not subject to any particular limitation, is preferably at least 40, more preferably at least 45, and even more preferably at least 47. The upper limit, although not subject to any particular limitation, is preferably not more than 62, more preferably not more than 58, and even more preferably not more than 55. If the intermediate envelope layer is too soft, the ball may have too much spin receptivity on full shots, as a result of which an increased distance may not be achieved. On the other hand, if the outer envelope layer is too hard, the durability of the ball to cracking under repeated impact may worsen or the ball may have too hard a feel when played.

In the present invention, it is preferable for the intermediate envelope layer to be formed so as to be harder than the inner envelope layer and softer than the outer envelope layer. In this case, although not subject to any particular limitation, the hardness difference between the intermediate envelope layer and the inner envelope layer, expressed in terms of the Shore D hardness, is set to a value of preferably at least 1, more preferably at least 2, and even more preferably at least 3. The upper limit, although not subject to any particular limitation, is set to preferably not more than 6, more preferably not more than 5, and even more preferably not more than 4. Likewise, the hardness difference between the intermediate envelope layer and the outer envelope layer, expressed in terms of the Shore D hardness, is set to a value of preferably at least 1, more preferably at least 2, and even more preferably at least 3. The upper limit, although not subject to any particular limitation, is set to preferably not more than 6, more preferably not more than 5, and even more preferably not more than 4. If the inner and outer envelope layers adjoining the intermediate envelope layer do not satisfy the above hardness relationships or the hardness differences do not fall within the above range, the ball may have too much spin receptivity on full shots, as a result of which an increased distance may not be achieved.

The intermediate envelope layer has a thickness which, although not subject to any particular limitation, is preferably at least 0.8 mm, more preferably at least 1.2 mm, and even more preferably at least 1.7 mm. The upper limit, although not subject to any particular limitation, is preferably not more than 3.8 mm, more preferably not more than 3.2 mm, and even more preferably not more than 2.7 mm. At an intermediate envelope layer thickness outside this range, the spin rate-lowering effect on shots with a driver (W#1) may be inadequate, as a result of which an increased distance may not be achieved.

The outer envelope layer which encases the intermediate envelope layer has a material hardness, expressed as the Shore D hardness, which, although not subject to any particular limitation, is preferably at least 42, more preferably at least 49 and even more preferably at least 51. The upper limit, although not subject to any particular limitation, is preferably not more than 65, more preferably not more than 62, and even more preferably not more than 60. Also, the outer envelope layer is preferably formed so as to be softer than the subsequently described intermediate layer. If the outer envelope layer is too soft, the ball may have too much spin receptivity on full shots, as a result of which an increased distance may not be achieved. On the other hand, if the outer envelope layer is too hard, the durability of the ball to cracking under repeated impact may worsen or the ball may have too hard a feel when played.

The outer envelope layer has a thickness which, although not subject to any particular limitation, is preferably at least 0.7 mm, more preferably at least 1.0 mm, and even more preferably at least 1.5 mm. The upper limit, although not subject to any particular limitation, is preferably not more than 3.5 mm, more preferably not more than 3.0 mm, and even more preferably not more than 2.5 mm. At an outer envelope layer thickness outside this range, the spin rate-lowering effect on shots with a driver (W#1) may be inadequate, as a result of which an increased distance may not be achieved.

The combined thickness of the inner envelope layer, intermediate envelope layer and outer envelope layer, i.e., the total thickness of the envelope layers, although not subject to any particular limitation, is preferably at least 2.5 mm, more preferably at least 3.7 mm, and even more preferably at least 5.2 mm. The upper limit, although not subject to any particular limitation, is preferably not more than 11.3 mm, more preferably not more than 9.7 mm, and even more preferably not more than 8.2 mm. At a total thickness for the envelope layers outside of the above range, the spin rate-lowering effect on shots with a driver (W#1) may be inadequate, as a result of which an increased distance may not be achieved.

In the present invention, the envelope layer is composed of three layers—an inner envelope layer, an intermediate envelope layer and an outer envelope layer, which respective layers may be made of the same or mutually differing resin materials. The materials which form these envelope layers may be, for example, rubber materials or resin materials, and are not subject to any particular limitation. However, in this invention, preferred use may be made of a material which includes as an essential component a base resin composed of, in admixture, specific amounts of (a) an olefin-unsaturated carboxylic acid random copolymer and/or a metal ion neutralization product of an olefin-unsaturated carboxylic acid random copolymer and (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer. In the invention, by using this material to form at least one of the envelope layers, the spin rate on shots with a driver (W#1) can be lowered, enabling a longer distance to be achieved. This material is described in detail below.

The olefin in the above base resin, whether in component (a) or component (b), has a number of carbons which is generally at least 2 but not more than 8, and preferably not more than 6. Specific examples include ethylene, propylene, butene, pentene, hexene, heptene and octene. Ethylene is especially preferred.

Examples of unsaturated carboxylic acids include acrylic acid, methacrylic acid, maleic acid and fumaric acid. Acrylic acid and methacrylic acid are especially preferred.

Moreover, the unsaturated carboxylic acid ester is preferably a lower alkyl ester of the above unsaturated carboxylic acid. Specific examples include methyl methacrylate, ethyl methacrylate, propyl methacrylate, butyl methacrylate, methyl acrylate, ethyl acrylate, propyl acrylate and butyl acrylate. Butyl acrylate (n-butyl acrylate, i-butyl acrylate) is especially preferred.

The olefin-unsaturated carboxylic acid random copolymer of component (a) and the olefin-unsaturated carboxylic acid-unsaturated carboxylic acid ester random terpolymer of component (b) (the copolymers in components (a) and (b) are referred to collectively below as "random copolymers") can each be obtained by random copolymerization of the above components using a known method.

It is recommended that the above random copolymers have unsaturated carboxylic acid contents (acid contents) which are regulated. Here, it is recommended that the content of unsaturated carboxylic acid present in the random copolymer serving as component (a), although not subject to any particular limitation, be set to preferably at least 4 wt %, more preferably at least 6 wt %, even more preferably at least 8 wt %, and most preferably at least 10 wt %. Also, it is recommended that the upper limit, although not subject to any particular limitation, be preferably not more than 30 wt %, more preferably not more than 20 wt %, even more preferably not more than 18 wt %, and most preferably not more than 15 wt %.

Similarly, the content of unsaturated carboxylic acid present in the random copolymer serving as component (b), although not subject to any particular limitation, may be set to preferably at least 4 wt %, more preferably at least 6 wt %, and even more preferably at least 8 wt %. Also, it is recommended that the upper limit, although not subject to any particular limitation, be preferably not more than 15 wt %, more preferably not more than 12 wt %, and even more preferably not more than 10 wt %. If the acid content of the random copolymer is too low, the resilience may decrease, whereas if it is too high, the processability may decrease.

The metal ion neutralization products of the random copolymers of components (a) and (b) may be obtained by neutralizing some of the acid groups on the random copolymer with metal ions. Here, specific examples of metal ions for neutralizing the acid groups include $Na^+$, $K^+$, $Li^+$, $Zn^{++}$, $Cu^{++}$, $Mg^{++}$, $Ca^{++}$, $Co^{++}$, $Ni^{++}$ and $Pb^{++}$. Of these, preferred use can be made of, for example, $Na^+$, $Li^+$, $Zn^{++}$ and $Mg^{++}$. Moreover, from the standpoint of improving resilience, the use of $Na^+$ is recommended. The degree of neutralization of the random copolymer by these metal ions is not subject to any particular limitation. Such neutralization products may be obtained by a known method. For example, use may be made of a method in which neutralization is carried out with a compound such as a formate, acetate, nitrate, carbonate, bicarbonate, oxide, hydroxide or alkoxide of the above-mentioned metal ions.

Sodium ion-neutralized ionomer resins may be suitably used as the above metal ion neutralization products of the random copolymers to increase the melt flow rate (MFR) of the material. In this way, adjustment of the material to the subsequently described optimal melt flow rate is easy, enabling the moldability to be improved.

Commercially available products may be used as above components (a) and (b). Illustrative examples of the random copolymer in component (a) include Nucrel N1560, Nucrel N1214, Nucrel N1035 and Nucrel AN4221C (all products of DuPont-Mitsui Polychemicals Co., Ltd.), and Escor 5200, Escor 5100 and Escor 5000 (all products of ExxonMobil Chemical). Illustrative examples of the random copolymer in component (b) include Nucrel AN4311, Nucrel AN4318 and Nucrel AN4319 (all products of DuPont-Mitsui Polychemicals Co., Ltd.), and Escor ATX325, Escor ATX320 and Escor ATX310 (all products of ExxonMobil Chemical).

Illustrative examples of the metal ion neutralization product of the random copolymer in component (a) include Himilan 1554, Himilan 1557, Himilan 1601, Himilan 1605, Himilan 1706, Himilan 1707 and Himilan AM7311 (all products of DuPont-Mitsui Polychemicals Co., Ltd.), Surlyn 7930 (E.I. DuPont de Nemours & Co.), and Iotek 3110 and Iotek 4200 (both products of ExxonMobil Chemical). Illustrative examples of the metal ion neutralization product of the random copolymer in component (b) include Himilan 1855, Himilan 1856 and Himilan AM7316 (all products of DuPont-Mitsui Polychemicals Co., Ltd.), Surlyn 6320, Surlyn 8320, Surlyn 9320 and Surlyn 8120 (all products of E.I. DuPont de Nemours & Co.), and Iotek 7510 and Iotek 7520 (both products of ExxonMobil Chemical). Sodium-neutralized ionomer resins that are suitable as the metal ion neutralization product of the random copolymer include Himilan 1605, Himilan 1601 and Himilan 1555.

When preparing the above-described base resin, component (a) and component (b) are admixed in a weight ratio of generally between 100:0 and 0:100, preferably between 100:0 and 25:75, more preferably between 100:0 and 50:50, even more preferably between 100:0 and 75:25, and most preferably 100:0. If too little component (a) is included, the molded material obtained therefrom may have a decreased resilience.

The processability of the base resin can be further improved by, in addition to adjusting the above mixing ratio, also adjusting the mixing ratio between the random copolymers and the metal ion neutralization products of the random copolymers. In this case, it is recommended that the weight ratio of the random copolymers to the metal ion neutralization products of the random copolymers be set to generally between 0:100 and 60:40, preferably between 0:100 and 40:60, more preferably between 0:100 and 20:80, and even more preferably 0:100. The addition of too much random copolymer may lower the uniformity of the pellet composition.

A non-ionomeric thermoplastic elastomer (e) may be included in the base resin so as to enhance even further both the feel of the ball on impact and the rebound. Examples of this component (e) include olefin elastomers, styrene elastomers, polyester elastomers, urethane elastomers and polyamide elastomers. In this invention, to further increase the rebound, it is preferable to use a polyester elastomer or an olefin elastomer. The use of an olefin elastomer composed of a thermoplastic block copolymer which includes crystalline polyethylene blocks as the hard segments is especially preferred.

A commercially available product may be used as component (e). Illustrative examples include Dynaron (JSR Corporation) and the polyester elastomer Hytrel (DuPont-Toray Co., Ltd.).

Component (e) may be included in an amount of more than 0. The upper limit in the amount included per 100 parts by weight of the base resin, although not subject to any particular limitation, is preferably not more than 100 parts by weight, more preferably not more than 60 parts by weight, even more preferably not more than 50 parts by weight, and most preferably not more than 40 parts by weight. Too much component (e) may lower the compatibility of the mixture, possibly resulting in a substantial decline in the durability of the golf ball.

Next, a fatty acid or fatty acid derivative having a molecular weight of at least 228 but not more than 1500 may be added as component (c) to the base resin. Compared with the base resin, this component (c) has a very low molecular weight and, by suitably adjusting the melt viscosity of the mixture, helps in particular to improve the flow properties. Moreover, component (c) includes a relatively high content of acid groups (or derivatives thereof), and is capable of suppressing an excessive loss of resilience.

The molecular weight of the fatty acid or fatty acid derivative of component (c) may be set to at least 228, preferably at least 256, more preferably at least 280, and even more preferably at least 300. The upper limit may be set to not more than 1500, preferably not more than 1000, more preferably not more than 600, and even more preferably not more than 500. If the molecular weight is too low, the heat resistance cannot be improved. On the other hand, if the molecular weight is too high, the flow properties cannot be improved.

Preferred use as the fatty acid or fatty acid derivative of component (c) may likewise be made of, for example, an unsaturated fatty acid (or derivative thereof) containing a double bond or triple bond on the alkyl moiety, or a saturated fatty acid (or derivative thereof) in which the bonds on the alkyl moiety are all single bonds. In either case, it is recommended that the number of carbons on the molecule be preferably at least 18, more preferably at least 20, even more preferably at least 22, and most preferably at least 24. It is recommended that the upper limit be preferably not more than 80, more preferably not more than 60, even more preferably not more than 40, and most preferably not more than 30. Too few carbons may make it impossible to improve the heat resistance and may also make the acid group content so high as to diminish the flow-improving effect on account of interactions with acid groups present in the base resin. On the other hand, too many carbons increases the molecular weight, which may keep a distinct flow-improving effect from appearing.

Specific examples of the fatty acid of component (c) include myristic acid, palmitic acid, stearic acid, 12-hydroxystearic acid, behenic acid, oleic acid, linoleic acid, linolenic acid, arachidic acid and lignoceric acid. Preferred use can be made of stearic acid, arachidic acid, behenic acid and lignoceric acid in particular.

The fatty acid derivative of component (c) is exemplified by metallic soaps in which the proton on the acid group of the fatty acid has been replaced with a metal ion. Examples of the metal ion include $Na^+$, $Li^+$, $Ca^{++}$, $Mg^{++}$, $Zn^{++}$, $Mn^{++}$, $Al^{+++}$, $Ni^{++}$, $Fe^{++}$, $Fe^{+++}$, $Cu^{++}$, $Sn^{++}$, $Pb^{++}$ and $Co^{++}$. Of these, $Ca^{++}$, $Mg^{++}$ and $Zn^{++}$ are especially preferred.

Specific examples of fatty acid derivatives that may be used as component (c) include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

Use may also be made of known metallic soap-modified ionomers (see, for example, U.S. Pat. Nos. 5,312,857, 5,306,760 and International Disclosure WO 98/46671) when using above-described components (a) and/or (b), and component (c).

The amount of component (c) included per 100 parts by weight of the resin components when above components (a), (b) and (e) have been suitably blended may be set to at least 5 parts by weight, preferably at least 10 parts by weight, more preferably at least 20 parts by weight, and even more preferably at least 30 parts by weight. The upper limit in the amount included may be set to not more than 120 parts by weight, preferably not more than 115 parts by weight, more preferably not more than 110 parts by weight, and even more preferably not more than 100 parts by weight. If the amount of component (c) included is too small, the melt viscosity may decrease, lowering the processability. On the other hand, if the amount included is too large, the durability may decrease.

A basic inorganic metal compound capable of neutralizing acid groups in the base resin and in component (c) may be added as component (d). In cases where this component (d) is not included and a metal soap-modified ionomer resin (e.g., the metal soap-modified ionomer resins cited in the above-mentioned patent publications) is used alone, the metallic soap and un-neutralized acid groups present on the ionomer resin undergo exchange reactions during mixture under heating, generating a large amount of fatty acid. Because the fatty acid has a low thermal stability and readily vaporizes during molding, it may cause molding defects. Moreover, if the fatty acid deposits on the surface of the molded material, it may substantially lower paint film adhesion or have other undesirable effects such as lowering the resilience of the resulting molded material.

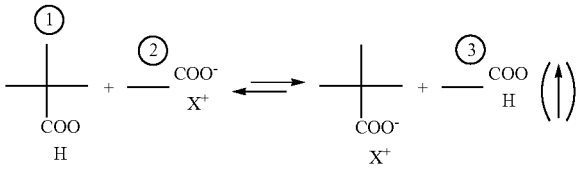

(1) un-neutralized acid group present on the ionomer resin
(2) metallic soap
(3) fatty acid
X: metal cation To solve this problem, a basic inorganic metal compound which neutralizes the acid groups present in the base resin and component (c) is included as component (d). By including component (d), the acid groups in the base resin and component (c) are neutralized. Moreover, synergistic effects from the blending of these respective components confer the resin composition with a number of excellent properties; namely, the resin composition has a higher thermal stability and at the same time is imparted with a good moldability, and the resilience as a golf ball-forming material is enhanced.

Illustrative examples of the metal ions used in the basic inorganic metal compound include $Li^+$, $Na^+$, $K^+$, $Ca^{++}$, $Mg^{++}$, $Zn^{++}$, $Al^{+++}$, $Ni^{++}$, $Fe^{++}$, $Fe^{+++}$, $Cu^{++}$, $Mn^{++}$, $Sn^{++}$, $Pb^{++}$ and $Co^{++}$. Known basic inorganic fillers containing these metal ions may be used as the basic inorganic metal compound. Specific examples include magnesium oxide, magnesium hydroxide, magnesium carbonate, zinc oxide, sodium hydroxide, sodium carbonate, calcium oxide, calcium hydroxide, lithium hydroxide and lithium carbonate. In particular, a hydroxide or a monoxide is recommended. Calcium hydroxide and magnesium oxide, which have a high reactivity with the base resin, are more preferred. Magnesium oxide is especially preferred.

The amount of component (d) included per 100 parts by weight of the resin component may be set to at least 0.1 part by weight, preferably at least 0.5 part by weight, more preferably at least 1 part by weight, and even more preferably at least 1.2 parts by weight. The upper limit in the amount included may be set to not more than 17 parts by weight, preferably not more than 15 parts by weight, more preferably not more than 10 parts by weight, and even more preferably not more than 5 parts by weight. Too little component (d) fails to improve thermal stability and resilience, whereas too much instead lowers the heat resistance of the golf ball-forming material due to the presence of excess basic inorganic metal compound.

By blending specific respective amounts of components (c) and (d) with the resin component, i.e., the base resin containing specific respective amounts of components (a) and (b) in admixture with optional component (e), a material having excellent thermal stability, flow properties and moldability can be obtained, in addition to which the resilience of moldings obtained therefrom can be markedly improved.

It is recommended that the material formulated from specific amounts of the above-described resin component and components (c) and (d) have a high degree of neutralization (i.e., that the material be highly neutralized). Specifically, it is recommended that at least 50 mol %, preferably at least 60 mol %, more preferably at least 70 mol %, and even more preferably at least 80 mol %, of the acid groups in the material be neutralized. Highly neutralizing the acid groups in the material makes it possible to more reliably suppress the exchange reactions that cause trouble when only a base resin and a fatty acid or fatty acid derivative are used as in the above-cited prior art, thus preventing the generation of fatty acid. As a result, the thermal stability is substantially improved and the processability is good, making it possible to obtain molded products of much better resilience than prior-art ionomer resins.

"Degree of neutralization," as used here, refers to the degree of neutralization of acid groups present within the mixture of the base resin and the fatty acid or fatty acid derivative serving as component (c), and differs from the degree of neutralization of the ionomer resin itself when an ionomer resin is used as the metal ion neutralization product of a random copolymer in the base resin. When a mixture of the invention having a certain degree of neutralization is compared with an ionomer resin alone having the same degree of neutralization, because the material of the invention contains a very large number of metal ions owing to the inclusion of component (d), the density of ionic crosslinks which contribute to improved resilience is increased, making it possible to confer the molded product with an excellent resilience.

The resin material should preferably have a melt flow rate (MFR) adjusted within a specific range in order to ensure flow properties that are particularly suitable for injection molding, and thus improve moldability. In this case, it is recommended that the melt flow rate, as measured in general accordance with JIS-K7210 at a temperature of 190° C. and under a load of 21.18 N (2.16 kgf), be adjusted to preferably at least 0.6 g/min, more preferably at least 0.7 g/min, even more preferably at least 0.8 g/min, and most preferably at least 2 g/min. It is recommended that the upper limit be adjusted to preferably not more than 20 g/min, more preferably not more than 10 g/min, even more preferably not more than 5 g/min, and most preferably not more than 3 g/min. Too high or low a melt flow rate may result in a substantial decline in processability.

Commercial products may be used as the envelope layer-forming materials. Specific examples include those having the trade names HPF 1000, HPF 2000, HPF AD1027, HPF AD1035 and HPF AD1040, as well as the experimental material HPF SEP1264-3, all produced by E.I. DuPont de Nemours & Co.

Next, the intermediate layer is described.

The intermediate layer has a material hardness, expressed as the Shore D hardness (measured value obtained with a type D durometer in accordance with ASTM D 2240), which, while not subject to any particular limitation, is preferably at least 55, more preferably at least 60, and even more preferably at least 63. The upper limit, although not subject to any particular limitation, may be set to preferably not more than 75, more preferably not more than 70, and even more preferably not more than 68. If the intermediate layer material is softer than the above range, the ball may have too much spin receptivity on full shots, as a result of which an increased distance may not be attained. On the other hand, if this material is harder than the above range, the durability of the ball to cracking on repeated impact may worsen or the ball may have too hard a feel when played with a putter and on short approach shots.

The intermediate layer has a thickness which, while not subject to any particular limitation, is preferably at least 0.5 mm, more preferably at least 0.9 mm, and even more preferably at least 1.0 mm. The upper limit, although not subject to any particular limitation, may be set to preferably not more than 2.5 mm, more preferably not more than 1.7 mm, and even more preferably not more than 1.4 mm. If the intermediate layer thickness is too thin, the durability to cracking on repeated impact or the low-temperature durability may worsen. On the other hand, if it is too thick, the feel on impact may become too hard or the inner layers will be made softer to achieve a hardness balance for the ball as a whole, which may result in the ball having a lower initial velocity when struck with a W#1 and thus failing to achieve a sufficient distance.

Materials which may be used in the intermediate layer are not subject to any particular limitation. However, because of their high rigidity and high resilience, the use of an ionomer resin is most preferred. Such an ionomer resin is exemplified by, in particular, ionomer resins in which some of the carboxylic acids (i.e., acid groups) in a copolymer of an α-olefin and an α,β-unsaturated carboxylic acid of 3 to 8 carbons are neutralized with metal ions, ionomer resins in which some of the carboxylic acids in a terpolymer of an α-olefin, an α,β-unsaturated carboxylic acid of 3 to 8 carbons and an α,β-unsaturated carboxylic acid ester are neutralized with metal ions, and mixtures thereof.

The α-olefin in the ionomer resin is preferably ethylene or propylene. Examples of the α,β-unsaturated carboxylic acid include acrylic acid, methacrylic acid, fumaric acid, maleic acid and crotonic acid, with acrylic acid and methacrylic acid being especially preferred. Examples of the α,β-unsaturated carboxylic acid ester include the methyl, ethyl, propyl, n-butyl and isobutyl esters of acrylic acid, methacrylic acid, fumaric acid and maleic acid. Acrylic acid esters and methacrylic acid esters are especially preferred. Examples of the metal ions which neutralize the acid groups in the copolymer include $Na^+$, $K^+$, $Li^+$, $Zn^{++}$, $Ca^{++}$, $Mg^{++}$, $Al^{+++}$ and $Nd^{+++}$. From the standpoint of rebound and durability, $Na^+$, $Li^+$ and $Zn^{++}$ are preferred.

The content of unsaturated carboxylic acid (acid content) in the ionomer resin, although not subject to any particular limitation, may be set to a high acid content of preferably 16 wt %, more preferably 17 wt %, and even more preferably 18 wt %. The upper limit in the acid content, although not subject to any particular limitation, may be set to not more than 22 wt %, preferably 20 wt %, and more preferably 19 wt %.

A single ionomer resin having a high acid content of at least 16 wt % may be used alone, or two or more such ionomer resins may be used together, as the above-described ionomer resin of the intermediate layer. When two or more are used together, by making joint use of ionomer resins neutralized with different metal ions, further improvements in the rebound and durability to repeated impact can be achieved.

A commercially available product may be used as the intermediate layer-forming material. Specific examples include AM7317, AM7318 and AM7315 (all products of DuPont-Mitsui Polychemicals Co., Ltd.), and S9150, S8150 and S8220 (all products of E.I. DuPont de Nemours & Co.).

Commonly used additives, such as pigments, fillers for adjusting the specific gravity, dispersants, antioxidants, ultraviolet absorbers and light stabilizers, may be suitably added and blended into the above intermediate layer-forming material.

In this invention, although not subject to any particular limitation, from the standpoint of keeping marks and the like that arise during use of the ball from becoming conspicuous, it is preferable to form the cover of a resin material having a high degree of transparency. To this end, it is preferable for the intermediate layer to include a given amount of titanium oxide in order to block the underlying color. Here, titanium oxide may be included in just the amount needed to block the underlying color. The amount of titanium oxide included, although not subject to any particular limitation, may be set to at least 0.5 part by weight, preferably at least 1 part by weight, and more preferably at least 2 parts by weight, per 100 parts by weight of the resin component. The upper limit in the amount of titanium oxide included, although not subject to any particular limitation, may be set to not more than 10 parts by weight, preferably not more than 6 parts by weight, and more preferably not more than 4 parts by weight. The specific gravity of the material, although not subject to any particular limitation, may be set to a value of at least 0.92, preferably at least 0.96, and more preferably at least 0.97. The upper limit in the specific gravity, which also is not subject to any particular limitation, may be set to not more than 1.15, preferably not more than 1.05, and more preferably not more than 1.00. If the amount of titanium oxide included is small and the specific gravity is low, it may not be possible to block the underlying color, as a result of which the ball appearance may become darker. On the other hand, if the amount of titanium oxide added is large and the specific gravity is too high, the rebound may become low and a sufficient distance may not be achieved.

To increase adhesion between the intermediate layer formed of the above-described material and the polyurethane used in the subsequently described cover, it is desirable to abrade the surface of the intermediate layer prior to forming the cover. In addition, the adhesion can be further enhanced by applying a primer (adhesive) to the surface of the intermediate layer following such abrasion treatment or by adding an adhesion reinforcing agent to the intermediate layer-forming material. Examples of adhesion reinforcing agents that may be incorporated in the material include organic compounds such as 1,3-butanediol and trimethylolpropane, and oligomers such as polyethylene glycol and polyhydroxy polyolefin oligomers. The use of trimethylolpropane or a polyhydroxy polyolefin oligomer is especially preferred. Illustrative examples of commercially available products include trimethylolpropane produced by Mitsubishi Gas Chemical Co., Ltd. and polyhydroxy polyolefin oligomers produced by Mitsubishi Chemical Corporation (under the trade name designation Polytail H; number of main-chain carbons, 150 to 200; with hydroxyl groups at the ends).

Next, the cover is described. As used herein, the term "cover" denotes the outermost layer of the ball construction, and excludes what are referred to herein as the intermediate layer and the envelope layer.

The cover has a material hardness, expressed as the Shore D hardness, which, while not subject to any particular limitation, may be set to preferably at least 40, more preferably at least 43, and even more preferably at least 46. The upper limit, although not subject to any particular limitation, may be set to preferably not more than 60, more preferably not more than 57, and even more preferably not more than 54. At a cover material hardness lower than this range, the ball tends to take on too much spin on full shots, as a result of which an increased distance may not be achieved. On the other hand, at a cover material hardness higher than this range, on approach shots, the ball may lack spin receptivity and thus may have an inadequate controllability even when played by a professional or other skilled golfer. It is critical for the material hardness of the cover to be higher than the core center hardness.

The thickness of the cover, while not subject to any particular limitation, may be set to preferably at least 0.2 mm, more preferably at least 0.3 mm, and even more preferably at least 0.4 mm. The upper limit, although not subject to any particular limitation, may be set to preferably not more than 1.0 mm, more preferably not more than 0.9 mm, and even more preferably not more than 0.8 mm. If the cover is thicker than the above range, the ball may have an inadequate rebound on shots with a driver (W#1) or the spin rate may be too high, as a result of which an increased distance may not be achieved. On the other hand, if the cover is thinner than the above range, the ball may have a poor scuff resistance or may have inadequate controllability even when played by a professional or other skilled golfer.

The cover material, as with the above-described envelope layer and intermediate layer, is formed primarily of any of various types of resin materials. Although not subject to any particular limitation, from the standpoint of controllability and scuff resistance, use may be made of a material selected from among thermoplastic polyurethanes, thermoset polyurethanes and polyureas. Of these, from the standpoint of mass productivity, preferred use may be made of a thermoplastic polyurethane.

In the present invention, it is especially preferable to use a specific thermoplastic polyurethane composition composed primarily of (A) a thermoplastic polyurethane and (B) a polyisocyanate compound. This resin blend is described below.

This resin composition is composed primarily of (A) a thermoplastic polyurethane and (B) a polyisocyanate compound. Specifically, it is recommended that the total weight of components (A) and (B) combined be preferably at least 600, and more preferably at least 700, of the overall weight of the cover layer.

First, the thermoplastic polyurethane (A) is described. This thermoplastic polyurethane includes in the structure thereof soft segments made of a polymeric polyol that is a long-chain polyol (polymeric glycol), and hard segments made of a chain extender and a polyisocyanate compound. Here, the long-chain polyol used as a starting material is not subject to any particular limitation, and may be any that is used in the prior art relating to thermoplastic polyurethanes. Exemplary long-chain polyols include polyester polyols, polyether polyols, polycarbonate polyols, polyester polycarbonate polyols, polyolefin polyols, conjugated diene polymer-based polyols, castor oil-based polyols, silicone-based polyols and vinyl polymer-based polyols. These long-chain polyols may be used singly or as combinations of two or more thereof. Of the long-chain polyols mentioned here, polyether polyols are preferred because they enable the synthesis of thermoplastic polyurethanes having a high rebound resilience and excellent low-temperature properties.

Illustrative examples of the above polyether polyol include poly(ethylene glycol), poly(propylene glycol), poly(tetramethylene glycol) and poly(methyltetramethylene glycol) obtained by the ring-opening polymerization of cyclic ethers. The polyether polyol may be used singly or as a combination of two or more thereof. Of the above, poly(tetramethylene glycol) and/or poly(methyltetramethylene glycol) are preferred.

It is preferable for these long-chain polyols to have a number-average molecular weight in a range of 1,500 to 5,000. By using a long-chain polyol having a number-average molecular weight within this range, golf balls made with a thermoplastic polyurethane composition having excellent properties such as resilience and manufacturability can be reliably obtained. The number-average molecular weight of the long-chain polyol is more preferably in a range of 1,700 to 4,000, and even more preferably in a range of 1,900 to 3,000.

As used herein, "number-average molecular weight of the long-chain polyol" refers to the number-average molecular weight computed based on the hydroxyl number measured in accordance with JIS-K1557.

Chain extenders that may be suitably used include those employed in the prior art relating to thermoplastic polyurethanes. For example, low-molecular-weight compounds which have a molecular weight of 400 or less and bear on the molecule two or more active hydrogen atoms capable of reacting with isocyanate groups are preferred. Illustrative, non-limiting, examples of the chain extender include 1,4-butylene glycol, 1,2-ethylene glycol, 1,3-butanediol, 1,6-hexanediol and 2,2-dimethyl-1,3-propanediol. Of these chain extenders, aliphatic diols having 2 to 12 carbons are preferred, and 1,4-butylene glycol is especially preferred.

The polyisocyanate compound is not subject to any particular limitation; preferred use may be made of one that is used in the prior art relating to thermoplastic polyurethanes. Specific examples include one or more selected from the group consisting of 4,4'-diphenylmethane diisocyanate, 2,4-toluene diisocyanate, 2,6-toluene diisocyanate, p-phenylene diisocyanate, xylylene diisocyanate, naphthylene-1,5-diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. Depending on the type of isocyanate used, the crosslinking reaction during injection molding may be difficult to control. In the practice of the invention, to provide a balance between stability at the time of production and the properties that are manifested, it is most preferable to use 4,4'-diphenylmethane diisocyanate, which is an aromatic diisocyanate.

It is most preferable for the thermoplastic polyurethane serving as above component (A) to be a thermoplastic polyurethane synthesized using a polyether polyol as the long-chain polyol, using an aliphatic diol as the chain extender, and using an aromatic diisocyanate as the polyisocyanate compound. It is desirable, though not essential, for the polyether polyol to be a polytetramethylene glycol having a number-average molecular weight of at least 1,900, for the chain extender to be 1,4-butylene glycol, and for the aromatic diisocyanate to be 4,4'-diphenylmethane diisocyanate.

The mixing ratio of active hydrogen atoms to isocyanate groups in the above polyurethane-forming reaction can be adjusted within a desirable range so as to make it possible to obtain a golf ball which is composed of a thermoplastic polyurethane composition and has various improved properties, such as rebound, spin performance, scuff resistance and manufacturability. Specifically, in preparing a thermoplastic polyurethane by reacting the above long-chain polyol, polyisocyanate compound and chain extender, it is desirable to use the respective components in proportions such that the amount of isocyanate groups on the polyisocyanate compound per mole of active hydrogen atoms on the long-chain polyol and the chain extender is from 0.95 to 1.05 moles.

No particular limitation is imposed on the method of preparing the thermoplastic polyurethane used as component (A). Production may be carried out by either a prepolymer process or a one-shot process in which the long-chain polyol, chain extender and polyisocyanate compound are used and a known urethane-forming reaction is effected. Of these, a process in which melt polymerization is carried out in a substantially solvent-free state is preferred. Production by continuous melt polymerization using a multiple screw extruder is especially preferred.

Commercially available products may be used as above component (A). Illustrative examples include Pandex T8295, Pandex T8290, Pandex T8260 and Pandex T8283 (all available from DIC Bayer Polymer, Ltd.).

Next, concerning the polyisocyanate compound used as component (B), it is critical that, in at least some portion thereof, all the isocyanate groups on the molecule remain in an unreacted state prior to injection molding. That is, polyisocyanate compound in which all the isocyanate groups on the molecule remain in a completely free state must be present in the resin blend prior to injection molding. Such a polyisocyanate compound may be present together with polyisocyanate compound in which only one end of the molecule is in a free state.

Various types of isocyanates may be employed without particular limitation as the polyisocyanate compound. Illustrative examples include one or more selected from the group consisting of 4,4'-diphenylmethane diisocyanate, 2,4-toluene diisocyanate, 2,6-toluene diisocyanate, p-phenylene diisocyanate, xylylene diisocyanate, naphthylene-1,5-diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate and dimer acid diisocyanate. Of the above group of isocyanates, the use of 4,4'-diphenylmethane diisocyanate, dicyclohexylmethane diisocyanate and isophorone diisocyanate is preferable in terms of the balance between the influence on processability of, for example, the rise in viscosity accompanying the reaction with the thermoplastic polyurethane serving as component (A) and the physical properties of the resulting golf ball cover material.

In the cover of the inventive golf ball, although not an essential constituent, a thermoplastic elastomer other than the above-described thermoplastic polyurethane may be included as component (C) together with components (A) and (B). Including this component (C) in the above resin blend enables the flow properties of the resin blend to be further improved and enables improvements to be made in various properties required of golf ball cover materials, such as resilience and scuff resistance.

Illustrative examples of thermoplastic elastomers which may be used as component (C) include Hytrel 3046, Hytrel 4047, Hytrel 4767 and Hytrel 5557 (all products of Du-Pont-Toray Co., Ltd.), and Dynaron 6100P, Dynaron 6200P and Dynaron 4600P (all products of JSR Corporation).

Various additives may be optionally included in the above-described cover material. Exemplary additives include pigments, dispersants, antioxidants, ultraviolet absorbers, ultraviolet stabilizers, parting agents, plasticizers and inorganic fillers (e.g., zinc oxide, barium sulfate, titanium dioxide).

In the present invention, although not subject to any particular limitation, to render marks which arise when the ball is hit with an iron or a wedge less conspicuous, it is preferable for the cover material to be given a high degree of transparency. Also, although not subject to any particular limitation, titanium oxide may be included in the cover material so as to adjust the specific gravity. It is recommended that the amount of titanium oxide included be set to the minimum required from the standpoint of achieving a balance between the specific gravity and the transparency. Specifically, it is recommended that the amount of titanium oxide included per 100 parts by weight of the resin component be set to preferably not more than 4.0 parts by weight, more preferably not more than 1.0 part by weight, and even more preferably 0 part by weight (no addition). The specific gravity of the material, although not subject to any particular limitation, may be set to at least 0.95, preferably at least 1.00, and more preferably at least 1.10. The upper limit in the specific gravity, although not subject to any particular limitation, may be set to not more than 1.20, preferably not more than 1.15, and more preferably not more than 1.13. Setting the specific gravity lower than the above range will make it necessary to mix in an ionomer resin or the like having a low specific gravity, which may worsen the scuff resistance. On the other hand, setting the specific gravity higher than the above range will require the addition of a large amount of titanium oxide, which may render more conspicuous any marks that arise when the ball is struck with an iron or a wedge.

The color of the above-described cover material, although not subject to any particular limitation, may be changed according to user preferences and the like. For example, a fluorescent pigment or fluorescent dye that is yellow, orange, red, blue, pink or green may be suitably added.

Thickness Relationships of Inner Envelope Layer, Intermediate Envelope Layer, Outer Envelope Layer, Intermediate Layer and Cover In the present invention, although the thicknesses of the three envelope layers are not subject to any particular limitations, in general, it is preferable that they satisfy the condition $$\text{inner envelope layer} \geq \text{intermediate envelope layer} \geq \text{outer envelope layer},$$

and more preferable that they satisfy the condition $$\text{inner envelope layer} > \text{intermediate envelope layer} > \text{outer envelope layer}.$$

Moreover, the ratios (intermediate envelope layer thickness)/(outer envelope layer thickness)

and (inner envelope layer thickness)/(intermediate envelope layer thickness)

are each preferably at least 1.0, more preferably at least 1.1, and even more preferably at least 1.2. The upper limit may be set to preferably not more than 1.5, more preferably not more than 1.4, and even more preferably not more than 1.3. When the thicknesses of the respective layers do not satisfy the above relationships, an adequate spin rate-lowering effect may not be obtained on shots with a driver (W#1), which may make it impossible to achieve the desired distance.

Also, although not subject to any particular limitation, it is preferable to form the intermediate layer so as to have a larger thickness than the cover. In this case, it is preferable for the (intermediate layer thickness)/(cover thickness) value to be set to preferably at least 1.3, more preferably at least 1.5, and even more preferably at least 1.7. The upper limit, although not subject to any particular limitation, may be set to preferably not more than 4.0, more preferably not more than 3.0, and even more preferably not more than 2.5. When the relationship between the intermediate layer thickness and the cover thickness falls outside of the above range, the spin rate-lowering effect on shots with a driver (W#1) may be inadequate or the initial velocity may be low, as a result of which an increased distance may not be achieved.

Moreover, in the overall ball which includes the cover and the core, from the standpoint of the distance achieved on shots with a driver (W#1), it is most preferable that cover thickness<intermediate layer thickness<(outer envelope layer thickness+intermediate envelope layer thickness+inner envelope layer thickness (total envelope layer thickness))<core diameter, and that cover thickness<intermediate layer thickness<outer envelope layer thickness<intermediate envelope layer thickness<inner envelope layer thickness<core diameter.

Moreover, it is recommended that the following relationship be satisfied:

(cover thickness+intermediate layer thickness)<(outer envelope layer thickness+intermediate envelope layer thickness+inner envelope layer thickness (total envelope layer thickness)).

If the cover is thicker than the intermediate layer, the rebound of the ball may decrease or the ball may have excessive spin receptivity on full shots, as a result of which an increased distance may not be achieved. If the envelope layer is thinner than the intermediate layer, the spin rate-lowering effect may be insufficient, which may make it impossible to achieve the desired distance. Moreover, it is preferable for the total envelope layer thickness to be greater than (cover thickness+intermediate layer thickness). When this is not the case, a sufficient spin rate-lowering effect may not be obtained, as a result of which the desired distance may not be achieved.

Hardness Relationships of Core Surface, Envelope Layer, Intermediate Layer and Cover In this invention, it is critical for the material hardness (Shore D) of the cover and the center hardness (Shore D) of the core to satisfy the relationship cover material hardness>core center hardness, and for one of the inner layers (the envelope layers and the intermediate layer) to be formed so as to be harder than the cover material hardness and/or the average core hardness. If these relationships are not satisfied, the spin rate on full shots with a driver will be too high, as a result of which a sufficient distance may not be achieved.

Although not subject to any particular limitation, in the overall ball, it is preferable for the relationship cover material hardness<intermediate layer material hardness>outer envelope layer material hardness>core center hardness to be satisfied, more preferable for the relationship cover material hardness<intermediate layer material hardness>outer envelope layer material hardness>intermediate envelope layer material hardness>inner envelope layer material hardness>core center hardness to be satisfied, and even more preferable for the relationship cover material hardness<intermediate layer material hardness>outer envelope layer material hardness>intermediate envelope layer material hardness>inner envelope layer material hardness≥average core hardness>core center hardness to be satisfied. If the above relationship is not satisfied, the spin rate of the ball on full shots with a driver may be too high, preventing a sufficient distance from being achieved, the ball may not incur spin on approach shots, resulting in an inadequate controllability, or the ball may have a poor cover durability.

Multi-piece solid golf balls having the above-described core, envelope layers, intermediate layer and cover can be manufactured by a known process such as injection molding. More specifically, a multi-piece solid golf ball having a six-layer construction can be obtained by using press molding or injection molding to fabricate a core composed primarily of a rubber material, using specific injection-molding molds to successively form envelope layers and an intermediate layer around the core, then injection-molding a cover material over the resulting intermediate layer-encased sphere. Alternatively, another method may be used to form the cover in which a pair of half-cups are molded beforehand using the above-described cover material, the intermediate layer-encased sphere is enclosed in these half-cups, and molding under applied pressure is carried out at from 120 to 170° C. for 1 to 5 minutes.

In the golf ball of the invention, to further improve the aerodynamic properties and thereby increase the distance traveled by the ball, as in conventional golf balls, it is desirable to form a plurality of dimples on the surface of the cover. By optimizing dimple parameters, such as the types and total number of dimples, owing to synergistic effects with the above-described ball construction, the trajectory is more stable, making it possible to obtain a golf ball having an excellent distance performance. Moreover, the cover may be subjected to various types of treatment, such as surface preparation, stamping and painting in order to enhance the design and durability of the golf ball.

First, the total number of dimples, although not subject to any particular limitation, may be set to preferably at least 280, more preferably at least 300, and even more preferably at least 320. The upper limit may be set to preferably not more than 360, more preferably not more than 350, and even more preferably not more than 340. If the number of dimples is higher than the above range, the ball trajectory may become lower, possibly decreasing the distance traveled by the ball.

On the other hand, if the number of dimples is lower than the above range, the ball trajectory may become higher, as a result of which an increased distance may not be achieved.

The shapes of the dimples are not limited to circular shapes; one or more type from among, for example, various polygonal shapes, dewdrop shapes and oval shapes may be suitably selected. In cases where, for example, circular dimples are used, the diameter of the dimples may be set to at least about 2.5 mm but not more than about 6.5 mm, and the depth may be set to at least 0.08 mm but not more than 0.30 mm.

To fully manifest the aerodynamic characteristics of the dimples, the dimple coverage on the spherical surface of the golf ball, which is the sum of the individual dimple surface areas, each defined by the border of the flat plane circumscribed by the edge of a dimple, expressed as a ratio (SR) with respect to the spherical surface area of the ball were it to be free of dimples, is preferably at least 60% but not more than 900. Also, to optimize the trajectory of the ball, the value $V_0$ obtained by dividing the spatial volume of each dimple below the flat plane circumscribed by the edge of that dimple by the volume of a cylinder whose base is the flat plane and whose height is the maximum depth of the dimple from the base is preferably at least 0.35 but not more than 0.80. In addition, the VR value, which is the sum of the volumes of the individual dimples formed below the flat plane circumscribed by the edge of that dimple, as a percentage of the volume of the ball sphere were it to have no dimples thereon, is preferably at least 0.6% but not more than 1.0%. Outside the above ranges for these values, the ball may assume a trajectory that is not conducive to achieving a good distance, as a result of which the ball may fail to travel a sufficient distance when played.

The golf ball of the invention, which can be manufactured so as to conform with the Rules of Golf for competitive play, may be produced to a ball diameter which is of a size that will not pass through a ring having an inside diameter of 42.672 mm, but is not more than 42.80 mm, and to a weight of generally from 45.0 to 45.93 g.

As shown above, by having the envelope layer composed of three layers—an inner envelope layer, an intermediate envelope layer and an outer envelope layer, and by optimizing the respective thicknesses and hardnesses of the envelope layers, intermediate layer and cover as described above, the inventive golf ball is highly beneficial for professionals and other skilled golfers because it can lower the spin rate on full shots with a driver, is able to increase the distance and achieve a good controllability, having in particular an excellent ability to maintain a straight path on full shots, and also has a good feel on impact and an excellent scuff resistance.

EXAMPLES

Examples of the invention and Comparative Examples are given below by way of illustration, and not by way of limitation.

Examples 1 to 3, Comparative Examples 1 to 10

Formation of Core

Rubber compositions were formulated as shown in Table 1, then molded and vulcanized at 155° C. for 16 minutes to form cores.

TABLE 1

| | Example | | | Comparative Example | | | | | | | | | |
|---|---|---|---|---|---|---|---|---|---|---|---|---|---|
| | 1 | 2 | 3 | 1 | 2 | 3 | 4 | 5 | 6 | 7 | 8 | 9 | 10 |
| Polybutadiene | 100 | 100 | 100 | 100 | 100 | 100 | 100 | 100 | 100 | 100 | 100 | 100 | 100 |
| Zinc acrylate | 6.8 | 15.0 | 20.5 | 25.0 | 27.3 | 15.0 | 6.8 | 20.5 | 20.5 | 20.5 | 20.5 | 15.0 | 20.5 |
| Peroxide | 1.2 | 1.2 | 1.2 | 1.2 | 1.2 | 1.2 | 1.2 | 1.2 | 1.2 | 1.2 | 1.2 | 1.2 | 1.2 |
| Antioxidant | 0.1 | 0.1 | 0.1 | 0.1 | 0.1 | 0.1 | 0.1 | 0.1 | 0.1 | 0.1 | 0.1 | 0.1 | 0.1 |
| Zinc oxide | 101.8 | 100.8 | 100.2 | 91.7 | 91.4 | 95.3 | 93.4 | 91.5 | 97.2 | 56.4 | 31.9 | 92.2 | 26.8 |
| Zinc salt of pentachlorothiophenol | 1 | 1 | 1 | 1 | 1 | 1 | 1 | 1 | 1 | 1 | 1 | 1 | 1 |
| Zinc stearate | 5 | 5 | 5 | 5 | 5 | 5 | 5 | 5 | 5 | 5 | 5 | 5 | 5 |

Numbers in the table represents parts by weight.

The materials in Table 1 are described below.

Polybutadiene: Available under the trade name "BR 730" from JSR Corporation.

Peroxide: A mixture of 1,1-di(t-butylperoxy)cyclohexane and silica, available under the trade name "Perhexa C-40" from NOF Corporation.

Antioxidant: 2,2'-Methylenebis(4-methyl-6-t-butylphenol), available under the trade name "Nocrac NS-6" from Ouchi Shinko Chemical Industry Co., Ltd.

Zinc stearate: Available under the trade name "Zinc Stearate G" from NOF Corporation.

Formation of Envelope Layers, Intermediate Layer and Cover

Figure 2:
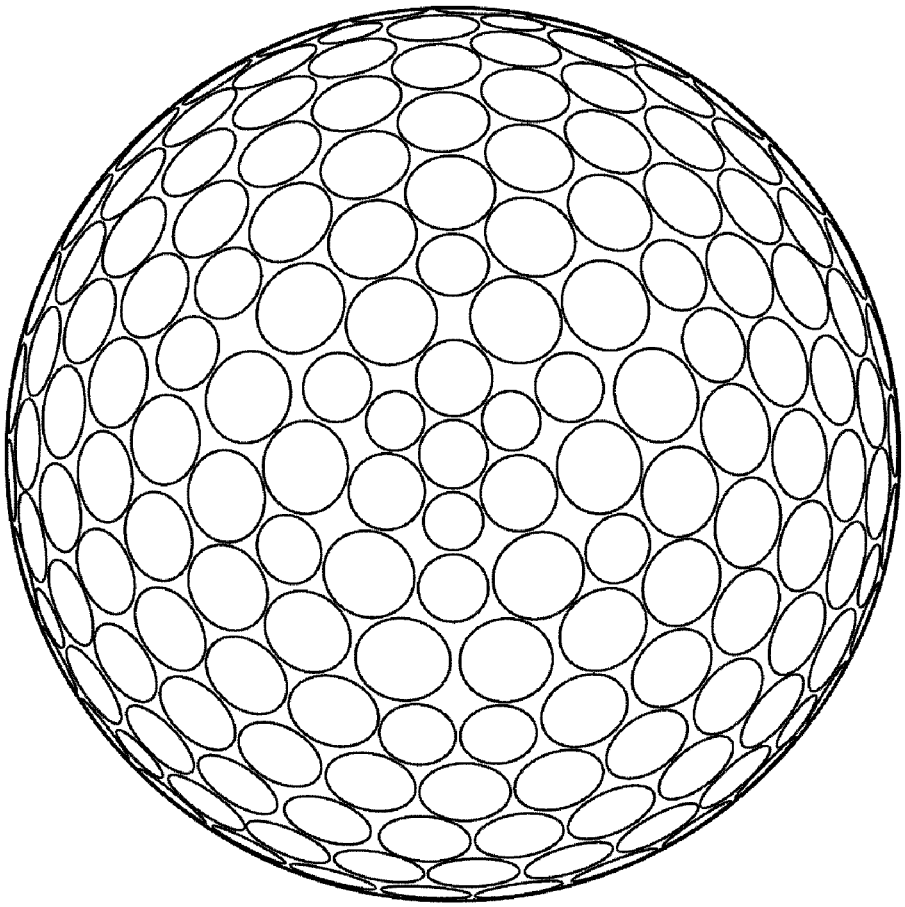
FIG. 2 is a top view showing the dimple pattern used on the balls in the examples.

Next, an inner envelope layer, outer envelope layer, intermediate layer and cover formulated as shown in Tables 2 and 3 were successively injection-molded over the core obtained above, thereby producing a multi-piece solid golf ball having a six-layer construction in which three envelope layers, an intermediate layer and a cover are formed over the core. At this time, the dimples shown in FIG. 2 were formed on the cover surface. Details on the dimples are given in Table 4.

TABLE 2

| Formulation (pbw) | No. 1 | No. 2 | No. 3 | No. 4 | No. 5 | No. 6 | No. 7 | No. 8 | No. 9 | No. 10 |
|---|---|---|---|---|---|---|---|---|---|---|
| AM7317 | | | | | | | 50 | | | |
| AM7318 | | | | | | | 50 | | | |
| Himilan 1707 | | | | | 100 | | | | | |
| Himilan 1605 | | | | | | | | 50 | 68.75 | 100 |
| Himilan 1557 | | | | | | | | 15 | | |
| Himilan 1706 | | | | | | | | 35 | | |
| Surlyn 8120 | | | | 100 | | | | | | |
| AN4319 | 100 | 100 | 20 | | | | | | | |
| AN4221C | | | 80 | | | | | | | |
| Dynaron 6100P | | | | | | | | | 31.25 | |
| Hytrel 3046 | | | | | | 100 | | | | |
| Behenic acid | | | | | | | | | 18 | |
| Calcium hydroxide | | | | | | | | | 2.3 | |
| Calcium stearate | | | | | | | | | 0.15 | |
| Zinc stearate | | | | | | | | | 0.15 | |
| Magnesium stearate | 100 | 69 | 60 | | | | | | | |
| Magnesium oxide | 2.8 | 1.2 | 1.7 | | | | | | | |
| Trimethylolpropane | | | | 1.1 | | | 1.1 | 1.1 | | 1.1 |
| Polytail H | | | | | | | | | 2 | |
| Titanium oxide | | | | | | | 3 | | | |

The materials in Table 2 are described below.

AM7317: A high-stiffness ionomer resin, available from DuPont-Mitsui Polychemicals Co., Ltd., which is a zinc ionomer having an acid content of 18%.

AM7318: A high-stiffness ionomer resin, available from DuPont-Mitsui Polychemicals Co., Ltd., which is a sodium ionomer having an acid content of 18%.

Himilan: Ionomer resins available from DuPont-Mitsui Polychemicals Co., Ltd.

Surlyn: An ionomer resin available from E.I. DuPont de Nemours & Co.

AN4319, AN4221C: Available under the trade name "Nucrel" from DuPont-Mitsui Polychemicals Co., Ltd.

Dynaron 6100P: A hydrogenated polymer available from JSR Corporation.

Hytrel 3046: A polyester elastomer available, DuPont-Toray Co., Ltd.

Behenic acid: NAA222-S (beads), available from NOF Corporation.

Calcium hydroxide: CLS-B, available from Shiraishi Kogyo.

Magnesium oxide: Available under the trade name "Kyowamag MF150" from Kyowa Chemical Industry Co., Ltd.

Polytail H: A low-molecular-weight polyolefin polyol produced by Mitsubishi Chemical Corporation.

TABLE 3

| Formulation (pbw) | No. 11 | No. 12 | No. 13 | No. 14 |
|---|---|---|---|---|
| Hytrel 4001 | 15 | | 15 | 15 |
| T-8290 | 100 | | | 100 |
| T-8260 | | 100 | | |
| T-8283 | | | 100 | |
| Titanium oxide | 3.5 | 3.8 | 3.5 | |
| Polyethylene wax | 1.5 | 1.4 | 1.5 | 1.5 |
| Isocyanate compound (1) | 9 | | 9 | 9 |
| Isocyanate compound (2) | | 18 | | |
| Yellow fluorescent pigment | | | | 1.5 |

The materials in Table 3 are described below.

Hytrel 4001: A polyester elastomer available from DuPont-Toray Co., Ltd.

T-8260, T-8290, T-8283: MDI-PTMG type thermoplastic polyurethanes available under the trade name "Pandex" from DIC Bayer Polymer.

Polyethylene wax: Available under the trade name "Sanwax 161P" from Sanyo Chemical Industries, Ltd.

Isocyanate compound (1): 4,4'-Diphenylmethane diisocyanate.

Isocyanate compound (2): An isocyanate masterbatch available under the trade name "Crossnate EM30" from Dainichi Seika Colour & Chemicals Mfg. Co., Ltd. Contains 300 of 4,4'-diphenylmethane diisocyanate. Measured concentration of amine reverse-titrated isocyanate according to JIS-K1556, 5 to 10%. A polyester elastomer was used as the masterbatch base resin. Isocyanate (2) was used after admixture with Pandex at the time of injection molding.

TABLE 4

| No. | Number of dimples | Diameter (mm) | Depth (mm) | $V_0$ | SR | VR |
|---|---|---|---|---|---|---|
| 1 | 18 | 4.6 | 0.13 | 0.53 | 81.6 | 0.819 |
| 2 | 234 | 4.5 | 0.14 | 0.53 | | |
| 3 | 42 | 3.7 | 0.14 | 0.53 | | |
| 4 | 12 | 3.3 | 0.13 | 0.53 | | |
| 5 | 6 | 3.0 | 0.16 | 0.53 | | |
| 6 | 14 | 3.5 | 0.14 | 0.53 | | |
| Total | 326 | | | | | |

Dimple Definitions

Diameter: Diameter of flat plane circumscribed by edge of dimple.

Depth: Maximum depth of dimple from flat plane circumscribed by edge of dimple.

$V_0$: Spatial volume of dimple below flat plane circumscribed by dimple edge, divided by volume of cylinder whose base is the flat plane and whose height is the maximum depth of dimple from the base.

SR: Sum of individual dimple surface areas, each defined by the flat plane circumscribed by the edge of a dimple, as a percentage of surface area of ball sphere were it to have no dimples thereon. (units: %)

VR: Sum of volumes of individual dimples formed below flat plane circumscribed by the edge of the dimple, as a percentage of volume of ball sphere were it to have no dimples thereon (units: %).

The various golf balls obtained were tested and evaluated by the methods described below with regard to properties of the various layers, such as thickness, hardness and deflection, and also flight performance and scuff resistance. The results are shown in Tables 5 to 7. All measurements were carried out in a 23° C. atmosphere.

(1) Core Deflection (mm)

The core was placed on a hard plate, and the amount of deformation by the core when compressed under a final load of 1,275 N (130 kgf) from an initial load state of 98 N (10 kgf) was measured.

(2) Core Surface Hardness

The durometer indenter was set substantially perpendicular to the spherical surface of the core, and JIS-C hardness measurements (in accordance with JIS-K6301) were taken at two randomly selected points on the core surface. The average of the two measurements was used as the core surface hardness. In addition, the Shore D hardness of the core surface was measured by the same method as just described, but using a type D durometer in accordance with ASTM-2240.

(3) Core Center Hardness

The core was cut into half, creating a flat plane. The durometer indenter was set substantially perpendicular at the center thereof, and the JIS-C hardness was measured (in accordance with JIS-K6301). In addition, the Shore D hardness of the core center was measured by the same method as just described, but using a type D durometer in accordance with ASTM-2240.

(4) Material Hardnesses of Envelope Layers, Intermediate Layer and Cover

The respective layer-forming materials were formed into sheets having a thickness of about 2 mm and held for two weeks at 23° C., following which the hardnesses were measured with a type D durometer in accordance with ASTM D-2240.

(5) Flight Performance on Shots with Driver

The distance traveled by the ball when hit at a head speed (HS) of 52 m/s with a driver (abbreviated below as "W#1"; TourStage X-Drive 430 (2007 model), manufactured by Bridgestone Sports Co., Ltd.; loft angle, 10.5°) mounted on a golf swing robot was measured. The results were rated according to the criteria shown below. The spin rate was the value measured for the ball, using an apparatus for measuring initial conditions, immediately after the ball was hit in the same way as described above.

Good: Total distance was 260 m or more

NG: Total distance was less than 260 m (6) Flight Performance on Shots with Iron The distance traveled by the ball when hit at a head speed (HS) of 43 m/s with an iron (abbreviated below as "I#6"; TourStage X-Blade (2005 model), manufactured by Bridgestone Sports Co., Ltd.) mounted on a golf swing robot were measured. The results were rated according to the criteria shown below. The spin rate was measured in the same way as described above.

Good: Total distance was 183 m or more

NG: Total distance was less than 183 m (7) Spin Rate on Approach Shots

The spin rate of a ball hit at a head speed (HS) of 20 m/s with a sand wedge (abbreviated below as "SW"; TourStage X-Wedge (2008 model), manufactured by Bridgestone Sports Co., Ltd.) mounted on a golf swing robot was measured. The results were rated according to the criteria shown below. As described above, the spin rate was the value measured, using an apparatus for measuring initial conditions, immediately after impact.

Good: Spin rate of 6,000 rpm or more

NG: Spin rate of less than 6,000 rpm (8) Scuff Resistance

A non-plated pitching sand wedge was set in a swing robot and the ball was hit once at a head speed of 40 m/s, following which the surface state of the ball was visually examined and rated as follows.

Exc: No significant damage

Good: Still usable

NG: No longer usable

TABLE 5

| | | Example | | |
|---|---|---|---|---|
| | | 1 | 2 | 3 |
| Core | Diameter (mm) | 27.0 | 27.0 | 27.0 |
| | Weight (g) | 16.3 | 16.3 | 16.3 |
| | Deflection (mm) | 8.3 | 5.7 | 4.6 |
| | Surface hardness (Shore D) | 31 | 44 | 51 |
| | Surface hardness (JIS-C) | 51 | 69 | 78 |
| | Center hardness (Shore D) | 24 | 36 | 40 |
| | Center hardness (JIS-C) | 42 | 58 | 63 |
| | Average hardness (Shore D) | 27 | 40 | 45 |
| | Surface hardness – center hardness (Shore D) | 7 | 8 | 11 |
| | Surface hardness – center hardness (JIS-C) | 9 | 11 | 15 |
| Inner envelope layer | Material | No. 1 | No. 1 | No. 1 |
| | Thickness (mm) | 2.6 | 2.6 | 2.6 |
| | Specific gravity | 0.95 | 0.95 | 0.95 |
| | Material hardness (Shore D) | 48 | 48 | 48 |
| Inner envelope layer-encased sphere | Diameter (mm) | 32.2 | 32.2 | 32.2 |
| | Weight (g) | 23.1 | 23.1 | 23.1 |
| Intermediate envelope layer | Material | No. 2 | No. 2 | No. 2 |
| | Thickness (mm) | 2.2 | 2.2 | 2.2 |
| | Specific gravity | 0.95 | 0.95 | 0.95 |
| | Material hardness (Shore D) | 51 | 51 | 51 |
| Intermediate envelope layer-encased sphere | Diameter (mm) | 36.6 | 36.6 | 36.6 |
| | Weight (g) | 30.9 | 30.9 | 30.9 |
| Outer envelope layer | Material | No. 3 | No. 3 | No. 3 |
| | Thickness (mm) | 1.7 | 1.7 | 1.7 |
| | Specific gravity | 0.95 | 0.95 | 0.95 |
| | Material hardness (Shore D) | 55 | 55 | 55 |

TABLE 5-continued

| | | Example | | |
|---|---|---|---|---|
| | | 1 | 2 | 3 |
| Outer envelope layer-encased sphere | Diameter (mm) | 40.0 | 40.0 | 40.0 |
| | Weight (g) | 38.3 | 38.3 | 38.3 |
| Intermediate layer | Material | No. 7 | No. 7 | No. 7 |
| | Thickness (mm) | 1.2 | 1.2 | 1.2 |
| | Specific gravity | 0.97 | 0.97 | 0.97 |
| | Material hardness (Shore D) | 65 | 65 | 65 |
| Intermediate layer-encased sphere | Diameter (mm) | 41.5 | 41.5 | 41.5 |
| | Weight (g) | 42.1 | 42.1 | 42.1 |
| Cover | Material | No. 14 | No. 14 | No. 14 |
| | Thickness (mm) | 0.6 | 0.6 | 0.6 |
| | Specific gravity | 1.12 | 1.12 | 1.12 |
| | Material hardness (Shore D) | 49 | 49 | 49 |
| Ball | Diameter (mm) | 42.7 | 42.7 | 42.7 |
| | Weight (g) | 45.5 | 45.5 | 45.5 |
| | Cover material hardness – core center hardness (Shore D) | 25 | 13 | 9 |

TABLE 6

| | | Comparative Example | | | | | | | | | |
|---|---|---|---|---|---|---|---|---|---|---|---|
| | | 1 | 2 | 3 | 4 | 5 | 6 | 7 | 8 | 9 | 10 |
| Core | Diameter (mm) | 27.0 | 27.0 | 27.0 | 26.8 | 26.9 | 26.9 | 29.4 | 35.3 | 27.0 | 36.7 |
| | Weight (g) | 15.9 | 15.9 | 16.0 | 15.5 | 15.7 | 16.0 | 18.0 | 28.0 | 13.6 | 30.6 |
| | Deflection (mm) | 3.2 | 2.5 | 5.7 | 8.3 | 4.6 | 4.6 | 4.6 | 4.6 | 5.7 | 4.6 |
| | Surface hardness (Shore D) | 57 | 60 | 44 | 31 | 51 | 51 | 51 | 51 | 44 | 51 |
| | Surface hardness (JIS-C) | 85 | 89 | 69 | 51 | 78 | 78 | 78 | 78 | 69 | 78 |
| | Center hardness (Shore D) | 42 | 44 | 36 | 24 | 40 | 40 | 40 | 40 | 36 | 40 |
| | Center hardness (JIS-C) | 66 | 68 | 58 | 42 | 63 | 63 | 63 | 63 | 58 | 63 |
| | Average hardness (Shore D) | 49 | 52 | 40 | 27 | 45 | 45 | 45 | 45 | 40 | 45 |
| | Surface hardness – center hardness (Shore D) | 14 | 16 | 8 | 7 | 11 | 11 | 11 | 11 | 8 | 11 |
| | Surface hardness – center hardness (JIS-C) | 19 | 21 | 11 | 9 | 15 | 15 | 15 | 15 | 11 | 15 |
| Inner envelope layer | Material | No. 1 | No. 1 | No. 1 | | | | | | | |
| | Thickness (mm) | 1.0 | 1.0 | 1.0 | | | | | | | |
| | Specific gravity | 0.95 | 0.95 | 0.95 | | | | | | | |
| | Material hardness (Shore D) | 48 | 48 | 48 | | | | | | | |
| Inner envelope layer-encased sphere | Diameter (mm) | 29.0 | 29.0 | 29.0 | | | | | | | |
| | Weight (g) | 18.2 | 18.2 | 18.3 | | | | | | | |
| Intermediate envelope layer | Material | No. 2 | No. 2 | No. 4 | | | | | | | |
| | Thickness (mm) | 2.3 | 2.3 | 2.3 | | | | | | | |
| | Specific gravity | 0.95 | 0.95 | 0.94 | | | | | | | |
| | Material hardness (Shore D) | 51 | 51 | 45 | | | | | | | |
| Intermediate envelope layer-encased sphere | Diameter (mm) | 33.6 | 33.6 | 33.6 | | | | | | | |
| | Weight (g) | 25.0 | 25.0 | 25.0 | | | | | | | |
| Outer envelope layer | Material | No. 3 | No. 1 | No. 1 | No. 2 | No. 2 | No. 5 | No. 2 | No. 2 | No. 6 | |
| | Thickness (mm) | 2.3 | 2.3 | 2.3 | 5.7 | 5.7 | 5.7 | 4.0 | 1.5 | 5.7 | |
| | Specific gravity | 0.95 | 0.95 | 0.95 | 0.95 | 0.95 | 0.94 | 0.95 | 0.95 | 1.07 | |
| | Material hardness (Shore D) | 55 | 48 | 48 | 51 | 51 | 62 | 51 | 51 | 30 | |
| Outer envelope layer-encased sphere | Diameter (mm) | 38.2 | 38.2 | 38.2 | 38.3 | 38.3 | 38.3 | 37.3 | 38.3 | 38.3 | |
| | Weight (g) | 33.8 | 33.8 | 33.9 | 33.8 | 33.9 | 34.0 | 31.2 | 34.0 | 34.0 | |
| Intermediate layer | Material | No. 8 | No. 4 | No. 4 | No. 8 | No. 9 | No. 10 | No. 8 | No. 8 | No. 8 | No. 8 |
| | Thickness (mm) | 1.3 | 1.3 | 1.3 | 1.2 | 1.2 | 1.2 | 1.0 | 1.2 | 1.2 | 2.0 |
| | Specific gravity | 0.95 | 0.94 | 0.94 | 0.95 | 0.93 | 0.95 | 0.95 | 0.95 | 0.95 | 0.95 |
| | Material hardness (Shore D) | 62 | 45 | 45 | 62 | 56 | 61 | 62 | 62 | 62 | 62 |
| Intermediate layer-encased sphere | Diameter (mm) | 40.7 | 40.7 | 40.7 | 40.7 | 40.7 | 40.7 | 39.3 | 40.7 | 40.7 | 40.7 |
| | Weight (g) | 39.6 | 39.6 | 39.6 | 39.4 | 39.4 | 39.6 | 35.6 | 39.6 | 39.6 | 39.5 |
| Cover | Material | No. 13 | No. 13 | No. 11 | No. 11 | No. 12 | No. 11 | No. 11 | No. 11 | No. 11 | No. 11 |
| | Thickness (mm) | 1.0 | 1.0 | 1.0 | 1.0 | 1.0 | 1.0 | 1.7 | 1.0 | 1.0 | 1.0 |
| | Specific gravity | 1.15 | 1.15 | 1.15 | 1.15 | 1.15 | 1.15 | 1.15 | 1.15 | 1.15 | 1.15 |
| | Material hardness (Shore D) | 40 | 40 | 49 | 49 | 58 | 49 | 49 | 49 | 49 | 49 |
| Ball | Diameter (mm) | 42.7 | 42.7 | 42.7 | 42.7 | 42.7 | 42.7 | 42.7 | 42.7 | 42.7 | 42.7 |
| | Weight (g) | 45.5 | 45.5 | 45.5 | 45.4 | 45.3 | 45.5 | 45.5 | 45.5 | 45.5 | 45.5 |
| | Cover material hardness – core center hardness (Shore D) | −2 | −4 | 13 | 25 | 18 | 9 | 9 | 9 | 13 | 9 |

TABLE 7

| | | | Example | | | Comparative Example | | | |
|---|---|---|---|---|---|---|---|---|---|
| | | | 1 | 2 | 3 | 1 | 2 | 3 | 4 |
| Flight performance | W#1 | Spin rate (rpm) | 2959 | 2969 | 3166 | 3321 | 3513 | 3350 | 2912 |
| | | Carry (m) | 240.8 | 244.4 | 246.7 | 243.6 | 240.6 | 241.0 | 239.7 |
| | | Total distance (m) | 263.6 | 264.7 | 266.0 | 258.1 | 254.8 | 258.4 | 259.7 |
| | | Rating | Good | Good | Good | NG | NG | NG | NG |
| | I#6 | Spin rate (rpm) | 5591 | 5590 | 6018 | 6870 | 7495 | 6678 | 5153 |
| | | Carry (m) | 170.9 | 171.4 | 170.7 | 164.2 | 161.2 | 165.2 | 172.4 |
| | | Total distance (m) | 186.8 | 188.4 | 185.8 | 175.5 | 170.3 | 177.1 | 187.8 |
| | | Rating | Good | Good | Good | NG | NG | NG | Good |
| | SW | Spin rate (rpm) | 6291 | 6286 | 6315 | 6573 | 6918 | 6358 | 6250 |
| | | Rating | Good | Good | Good | Good | Good | Good | Good |
| Scuff resistance | | | Exc | Exc | Exc | Good | Good | Good | Good |

| | | | Comparative Example | | | | | |
|---|---|---|---|---|---|---|---|---|
| | | | 5 | 6 | 7 | 8 | 9 | 10 |
| Flight performance | W#1 | Spin rate (rpm) | 2955 | 3155 | 3252 | 3312 | 3108 | 3160 |
| | | Carry (m) | 241.2 | 243.8 | 243.3 | 244.2 | 239.9 | 239.6 |
| | | Total distance (m) | 261.7 | 258.1 | 256.1 | 257.0 | 257.8 | 258.3 |
| | | Rating | Good | NG | NG | NG | NG | NG |
| | I#6 | Spin rate (rpm) | 5668 | 5867 | 6089 | 5895 | 5638 | 5793 |
| | | Carry (m) | 170.3 | 168.0 | 165.9 | 168.5 | 170.6 | 169.6 |
| | | Total distance (m) | 185.7 | 181.1 | 179.2 | 180.8 | 187.8 | 183.9 |
| | | Rating | Good | NG | NG | NG | Good | Good |
| | SW | Spin rate (rpm) | 5718 | 6324 | 6358 | 6235 | 6218 | 6150 |
| | | Rating | NG | Good | Good | Good | Good | Good |
| Scuff resistance | | | NG | Good | Good | Good | Good | Good |

The results in Table 7 show that the respective comparative examples were inferior to the present invention (working examples) in the following ways.

Comparative Example 1 was a six-piece solid golf ball in which the core center hardness was higher than the material hardness of the cover. On full shots, the spin rate was too high, resulting in a poor distance on shots with a W#1 and on shots with a I#6.

Comparative Example 2 was a six-piece solid golf ball in which each of the inner layers was softer than the average core hardness. On full shots, the spin rate was too high, resulting in a poor distance on shots with a W#1 and on shots with a I#6.

Comparative Example 3 was a six-piece solid golf ball in which each of the inner layers was softer than the cover. On full shots, the spin rate became too high, resulting in a poor distance on shots with a W#1 and on shots with a I#6.

Comparative Example 4 was a four-piece solid golf ball having a single envelope layer. Because a low spin rate and a high initial velocity when hit were not both achieved to a satisfactory degree, the distance traveled on shots with a W#1 was poor.

Comparative Example 5 was a four-piece solid golf ball having a hard cover and a single envelope layer. The spin rate on approach shots was inadequate and the scuff resistance was poor.

Comparative Example 6 was a four-piece solid golf ball having a single envelope layer that was hard. The spin rate-lowering effect was inadequate, in addition to which the initial velocity of the ball when hit was low, resulting in a poor distance.

Comparative Example 7 was a four-piece solid golf ball having a thick cover and a single envelope layer. The spin rate-lowering effect was inadequate, resulting in a poor distance.

Comparative Example 8 was a four-piece solid golf ball having a single envelope layer that was thin. The spin rate-lowering effect was inadequate, resulting in a poor distance.

Comparative Example 9 was a four-piece solid golf ball having a single envelope layer that was soft. The spin rate-lowering effect was inadequate, in addition to which the initial velocity of the ball when hit was low, resulting in a poor distance.

Comparative Example 10 was a three-piece solid golf ball without an envelope layer. The spin rate-lowering effect was inadequate, resulting in a poor distance.

The invention claimed is:

1. A multi-piece solid golf ball comprising a core, an envelope layer encasing the core, an intermediate layer encasing the envelope layer, and a cover which encases the intermediate layer and has formed on a surface thereof a plurality of dimples, wherein the envelope layer consists of an inner envelope layer, an intermediate envelope layer and an outer envelope layer, such that the total number of layers in the multi-piece solid golf ball is six; the inner, intermediate and outer envelope layers, the intermediate layer and the cover are each formed primarily of a resin material which may be of the same or different types; the core is formed primarily of a rubber material; the cover has a material hardness (Shore D) which is higher than a core center hardness (Shore D); and one of the inner layers has a material hardness (Shore D) which is higher than either or both of the cover material hardness (Shore D) and the average core hardness (defined as the arithmetic mean of the core surface hardness and the core center hardness), wherein the intermediate envelope layer is formed so as to be harder than the inner envelope layer and to have a material hardness difference (Shore D) with the inner envelope layer of from 1 to 4, and so as to be softer than the outer envelope layer and to have a material hardness difference (Shore D) with the outer envelope layer of from 1 to 4, wherein the inner envelope layer, intermediate envelope layer and outer envelope layer have thicknesses which satisfy the following relationship:

inner envelope layer thickness>intermediate envelope thickness>outer envelope layer thickness, and wherein the ratios (intermediate envelope layer thickness)/(outer envelope layer thickness) and (inner envelope layer thickness)/(intermediate envelope layer thickness) are each at least 1.1.

2. The multi-piece solid golf ball of claim 1, wherein the intermediate layer and the cover have thicknesses which satisfy the following relationship:

$$1.3 \leq \text{intermediate layer thickness/cover thickness} \leq 4.0.$$

3. The multi-piece solid golf ball of claim 1, wherein the intermediate layer is formed of a material which includes an ionomer resin having an acid content of at least 16 wt %.

4. The multi-piece solid golf ball of claim 1, wherein the core center, outer envelope layer, intermediate layer and cover have hardnesses (Shore D) which satisfy the following relationship:

cover material hardness<intermediate layer material hardness>outer envelope layer material hardness>core center hardness.

5. The multi-piece solid golf ball of claim 1, wherein the core center, inner envelope layer, intermediate envelope layer, outer envelope layer, intermediate layer and cover have hardnesses (Shore D) which satisfy the following relationship:

cover material hardness<intermediate layer material hardness>outer envelope layer material hardness>intermediate envelope layer material hardness>inner envelope layer material hardness>core center hardness.

6. The multi-piece solid golf ball of claim 1, wherein the core, inner envelope layer, intermediate envelope layer, outer envelope layer, intermediate layer and cover have thicknesses which satisfy the following relationship:

cover thickness<intermediate layer thickness<(outer envelope layer thickness+intermediate envelope layer thickness+inner envelope layer thickness)<core diameter.

7. The multi-piece solid golf ball of claim 1, wherein the inner envelope layer, intermediate envelope layer, outer envelope layer, intermediate layer and cover have thicknesses which satisfy the following relationship:

(cover thickness+intermediate layer thickness)<(outer envelope layer thickness+intermediate envelope layer thickness+inner envelope layer thickness).

8. The multi-piece solid golf ball of claim 1, wherein at least one layer from among the inner envelope layer, intermediate envelope layer and outer envelope layer is formed of a material obtained by blending:

an ionomer resin component of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (e) a non-ionomeric thermoplastic elastomer in a weight ratio between 100:0 and 50:50.

9. The multi-piece solid golf ball of claim 1, wherein at least one layer from among the inner envelope layer, intermediate envelope layer and outer envelope layer is formed of a material obtained by blending as essential components:

100 parts by weight of a resin component composed of, in admixture, a base resin of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (e) a non-ionomeric thermoplastic elastomer in a weight ratio between 100:0 and 50:50;

(c) from 5 to 120 parts by weight of a fatty acid and/or fatty acid derivative having a molecular weight of from 228 to 1500; and (d) from 0.1 to 17 parts by weight of a basic inorganic metal compound capable of neutralizing un-neutralized acid groups in the base resin and component (c).

10. The multi-piece solid golf ball of claim 9, wherein at least two layers from among the inner envelope layer, intermediate envelope layer and outer envelope layer are formed of a material obtained by blending as essential components:

100 parts by weight of a resin component composed of, in admixture, a base resin of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (e) a non-ionomeric thermoplastic elastomer in a weight ratio between 100:0 and 50:50;

(c) from 5 to 120 parts by weight of a fatty acid and/or fatty acid derivative having a molecular weight of from 228 to 1500; and (d) from 0.1 to 17 parts by weight of a basic inorganic metal compound capable of neutralizing un neutralized acid groups in the base resin and component (c).

11. The multi-piece solid golf ball of claim 9, wherein the inner envelope layer, intermediate envelope layer and outer envelope layer are all formed of a material obtained by blending as essential components:

100 parts by weight of a resin component composed of, in admixture, a base resin of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (e) a non-ionomeric thermoplastic elastomer in a weight ratio between 100:0 and 50:50;

(c) from 5 to 120 parts by weight of a fatty acid and/or fatty acid derivative having a molecular weight of from 228 to 1500; and (d) from 0.1 to 17 parts by weight of a basic inorganic metal compound capable of neutralizing un-neutralized acid groups in the base resin and component (c).

12. The multi-piece solid golf ball of claim 1, wherein the core has a deflection when compressed under a final load of 1,275 N (130 kgf) from an initial load state of 98 N (10 kgf) of at least 3.6 mm but not more than 12.0 mm.

13. The multi-piece solid golf ball of claim 1, wherein the envelope layer has a thickness which is at least twice the thickness of the intermediate layer.

14. The multi-piece solid golf ball of claim 1, wherein the cover is formed by injection molding a single resin blend composed primarily of (A) a thermoplastic polyurethane and (B) a polyisocyanate compound, which resin blend contains a polyisocyanate compound in at least some portion of which all the isocyanate groups remain in an unreacted state.

15. The multi-piece solid golf ball of claim 1, wherein the ratios (intermediate envelope layer thickness)/(outer envelope layer thickness) and (inner envelope layer thickness)/(intermediate envelope layer thickness) are each at least 1.2.

* * * * *